US007967161B2

(12) United States Patent
Townsend

(10) Patent No.: US 7,967,161 B2
(45) Date of Patent: Jun. 28, 2011

(54) CONTAINER LINER SYSTEMS

(76) Inventor: Arthur M. Townsend, Phoenix, AZ (US)

( * ) Notice: Subject to any disclaimer, the term of this patent is extended or adjusted under 35 U.S.C. 154(b) by 705 days.

(21) Appl. No.: 11/688,615

(22) Filed: Mar. 20, 2007

(65) Prior Publication Data

US 2007/0235509 A1 Oct. 11, 2007

Related U.S. Application Data

(60) Provisional application No. 60/784,212, filed on Mar. 20, 2006.

(51) Int. Cl.

| | |
|---|---|
| ***B65D 88/00*** | (2006.01) |
| ***B65D 25/14*** | (2006.01) |
| ***B65D 90/00*** | (2006.01) |
| ***B65D 33/00*** | (2006.01) |
| ***B65D 33/02*** | (2006.01) |

(52) U.S. Cl. ..... 220/1.6; 220/495.01; 220/495.05; 220/495.06; 220/651; 220/652; 220/653; 383/105; 383/119

(58) Field of Classification Search ..... 220/1.6, 220/495.01, 495.05, 495.06, 651, 652, 653; 229/117.3; 383/104, 105, 119, 903
See application file for complete search history.

(56) References Cited

U.S. PATENT DOCUMENTS

| | | | | |
|---|---|---|---|---|
| 3,578,213 | A * | 5/1971 | Clarke et al. | 222/95 |
| 3,731,828 | A * | 5/1973 | Clarke et al. | 414/412 |
| 3,951,284 | A * | 4/1976 | Fell et al. | 414/812 |
| 4,601,405 | A * | 7/1986 | Riemer | 220/1.5 |
| 5,193,710 | A * | 3/1993 | Podd et al. | 220/1.6 |
| 5,657,896 | A * | 8/1997 | Matias | 220/1.6 |
| 5,824,995 | A * | 10/1998 | Wise | 219/393 |
| 6,328,470 | B2 * | 12/2001 | Brown et al. | 383/119 |
| 6,398,053 | B1 * | 6/2002 | Thornsen | 220/1.6 |
| 6,662,962 | B2 * | 12/2003 | Neto | 220/1.6 |
| 2004/0134917 | A1 * | 7/2004 | Carnegie | 220/570 |

* cited by examiner

*Primary Examiner* — Anthony Stashick
*Assistant Examiner* — Madison L Wright
(74) *Attorney, Agent, or Firm* — Fennemore Craig, P.C.

(57) ABSTRACT

A shipping container liner system for use in the shipping of bulk flowable products is described. The system comprises a specially adapted shipping container liner that is self-supporting without the need of rear-mounted rigid supportive bars to retain the liner within the shipping container during filling and discharge. The system comprises an arrangement of interior support baffles operating in conjunction with a plurality of exterior anchor straps adapted to distribute the cargo load throughout the length of the liner. A specialized hopper for unloading the bulk material is also disclosed.

32 Claims, 14 Drawing Sheets

CONTAINER LINER SYSTEMS

CROSS-REFERENCE TO RELATED APPLICATION

The present application is related to and claims priority from prior provisional application Ser. No. 60/784,212, filed Mar. 20, 2006, entitled "CONTTAINER LINER SYSTEMS", the content of which is incorporated herein and is not admitted to be prior art with respect to the present invention by the mention in this cross-reference section.

BACKGROUND

This invention relates to providing systems for improving the operational performance of bulk shipping containers. More particularly this invention provides a system comprising specially adapted shipping container liners that are self-supporting, without the need of rear mounted rigid supportive bars, to retain the liner within the shipping container during filling. In addition, this invention provides an improved discharge hopper adapted to receive bulk material at an increased rate, appropriately matching the increased discharge rates of the fore-mentioned liner.

Container liners are large bag-like structures adapted to -fit within the interior of sea containers, truck trailers, and similar cargo-holding enclosures. They are used primarily to provide a clean and safe environment for the bulk transportation of industrial and agricultural products. These products commonly include minerals, powders, plastic pellets, rice, coffee beans, flour and grains, etc.

Typically, the container liner is loosely hung within the interior of the container. The bottom front of the liner is typically secured by a steel bar that slips through a sleeve, centered across the width of the liner, and loops made with strap material, sewn on either side of the liner (in line with the sleeve). The steel bar is then fitted into slots built into both sides of the front of the container. The back of the liner (located at the rear of the container near the access doors) comprises ports and chutes sewn into the upper and lower portions of the line. These ports and chutes are used to fill and discharge cargo. To prevent the liner from deflecting (bulging) out of the back of the container during filling, three to five steel bars are typically hung, in a horizontal position, on the back of the liner. Typically, the steel bars are supported by belt-loops sewn onto both sides of the rear of the liner, proportionally spaced from the top to the bottom. The bar ends are engaged in slots provided on either side of back of the container. These steel bars allow the container doors to be closed after filling, and function to hold the cargo-filled liner inside the container during the discharge of the product.

To discharge the product from the liner, the entire container is typically tipped like a dump truck. During the discharge operation, the steel bars act as a safety shield to prevent the liner from falling out of the container under the considerable weight of the stored cargo. Container liners now require these steel bars to be mounted in the rear of the container prior to filling. They are typically shipped with the container and are discarded after the container is emptied. The economic and environmental cost of using a new set of steel bars with each shipment is substantial.

A further significant problem associated with the use of conventional liners is the inconsistent placement of the liner within the interior of the container. Typically, the lower floor panel within the interior of the liner develops folds as the liner is installed, loaded, and unloaded. Existing liner systems do not provide means for smoothing and flattening the interior of the liner flat prior to use. Furthermore, existing liner systems do not maintain the interior of the liner in a flattened arrangement during product filling and discharge. Folds occurring within the interior of the liner typically slow the discharge of product as the containers are tipped, and often trap portions of the product that remains as residue within the liner.

A similar condition occurs within the discharge hopper as the liner chute develops folds and tears within the hopper's interior during discharge. Typically, this trapped product is lost and discarded along with the liner. In a large shipment, lost product may amount to several hundred pounds of residue material. Once again, the loss of product during the use of conventional liner systems has both economic and environmental implications.

Clearly, a need exists for improved container liners reducing waste associated with the retention of the liners within the containers using steel bars and the loss of product due to inconsistent and uneven placement of the liners within the containers. Furthermore, a need exists for improved discharge hoppers that facilitate rapid and complete discharge of materials.

OBJECTS AND FEATURES OF THE INVENTION

A primary object and feature of the present invention is to overcome the above-described problems.

Another primary object and feature of the present invention is to provide a shipping container liner system providing secure retention of the liner within the interior of the container without the use of conventional rear steel bar supports.

It is a further object and feature of the present invention to provide such a system having a distributed anchor system adapted to evenly distribute the contained product-load along multiple points of anchorage within the container length.

It is another object and feature of the present invention to provide such a distributed anchor system comprising a means for tensioning the anchors to draw the containment boundary of the liner into a flat configuration with minimal folding, creasing, and wrinkling.

It is a further object and feature of the present invention to provide an improved discharge hopper adapted to retain the discharge chute of the liner in an optimal configuration during unloading operations.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system related to handling a flowable material within the interior of a cargo container, such system comprising: a separating enclosure adapted to separately enclose substantially the entire volume of the interior of the cargo container; and a anchor adapted to anchor the separating enclosure within the interior; wherein the separating enclosure comprises a interior chamber adapted to contain the flowable material within the separating enclosure; wherein the interior chamber comprises a substantially vertical rear-boundary-wall, a substantially vertical forward-boundary wall, and a deflection limiter adapted to limit deflection of the substantially vertical rear-boundary-wall under a load imposed by the flowable material during containment within the separating enclosure; and wherein the deflection limiter comprises a load transfer member adapted to transfer a direct line of tensional force between the substantially vertical rear-boundary-wall and the substantially vertical forward-boundary-wall.

Moreover, it provides such a system wherein: the deflection limiter comprises at least three load transfer members; and each of such at least three load transfer members is adapted to transfer the direct line of tensional force between the substantially vertical rear-boundary-wall and the substantially vertical forward boundary-wall. Additionally, it provides such a system wherein the interior chamber further comprises: a substantially horizontal lower-containment-panel, and wherein the load transfer member does not intersect the substantially horizontal lower-containment-panel. Also, it provides such a system wherein the interior chamber further comprises: a substantially horizontal upper-containment panel; wherein both the substantially vertical rear-boundary-wall and such at least one substantially vertical forward-boundary-wall adjoins the substantially horizontal upper-containment-panel and the substantially horizontal lower-containment-panel. In addition, it provides such a system wherein the separating enclosure comprises at least one substantially flexible material. And, it provides such a system wherein the direct line of tensional force of the load transfer member comprises an angle greater than 45 degrees with respect to a plane comprising the substantially vertical rear boundary-wall.

Further, it provides such a system wherein the load transfer member comprises: a rear-boundary-wall end structured and arranged to intersect the substantially vertical rear-boundary-wall; and a forward-boundary-wall end structured and arranged to intersect the substantially vertical forward-boundary wall. Even further, it provides such a system wherein: the rear-boundary-wall end comprises a rear attacher adapted to attach the rear boundary-wall-end to the substantially vertical rear-boundary-wall; and the forward boundary-wall-end comprises a forward attacher adapted to attach the forward boundary-wall-end to the substantially vertical forward-boundary-wall. Moreover, it provides such a system wherein the substantially vertical forward boundary-wall comprises: a substantially vertical side-boundary-wall; and a substantially vertical front-boundary-wall; wherein the forward attacher is adapted to attach to the substantially vertical side-boundary-wall and such at least one substantially vertical front-boundary-wall; and wherein the forward attacher further comprises the anchor.

Additionally, it provides such a system wherein: the rear attacher comprises a rear attachment-length; the forward attacher comprises a forward attachment-length; and the rear attachment-length and the forward attachment-length are each oriented substantially perpendicular to the substantially horizontal lower-containment-panel. Also, it provides such a system wherein the rear attachment-length extends substantially between the substantially horizontal lower-containment-panel and the substantially horizontal upper containment-panel. In addition, it provides such a system wherein the forward attachment-length extends substantially between the substantially horizontal lower containment-panel and the substantially horizontal upper-containment-panel. And, it provides such a system wherein the separating enclosure further comprises at least one restraint-bar supporter adapted to assist in supporting the restraint bar in at least one position assisting restraint of the substantially flexible material against movement.

Further, it provides such a system wherein the anchor comprises: at least one external load-transfer-member adapted to transfer the load between the separating enclosure and the cargo container; wherein the external load transfer-member is located substantially outside the interior chamber. Even further, it provides such a system wherein: a portion of the load applied to the separating enclosure is generated by containment of the flowable material within the interior chamber; and the external load-transfer-member comprises a load divider adapted to assist in dividing the transfer of the load between a plurality of anchor points distributed along substantially a full length of the interior of the cargo container. Moreover, it provides such a system wherein: the external load-transfer-member comprises a strap; such at least one strap comprises a first strap-end and a second strap-end; such at least one first strap-end is firmly coupled to the separating enclosure; and such at least one second strap-end is adapted to assist anchoring; of the strap to the cargo container.

Additionally, it provides such a system wherein the strap further comprises a tensioner adapted to generate a tensional force between the first strap-end and the second strap-end. Also, it provides such a system wherein: the substantially horizontal lower-containment-panel comprises a peripheral edge; the peripheral edge comprises the strap; the tensioning of the strap by the tensioner assists in drawing such at least one substantially horizontal lower-containment-panel substantially within a single geometric plane; and discharge of the flowable material from the interior chamber is assisted by the positioning of the substantially horizontal lower-containment panel substantially within such single geometric plane. In addition, it provides such a system wherein the load-transfer-member comprises: a substantially unitary planar panel; and a aperture adapted to provide passage of the flowable material through the substantially unitary planar panel.

Also, the present invention provides such a system wherein: the substantially horizontal upper containment-panel comprises the anchor; and the substantially horizontal lower-containment-panel comprises the anchor. Further, it provides such a system wherein: the substantially vertical side-boundary wall comprises a first sidewall and a second sidewall; the deflection limiter comprises a first load-transfer-member adapted to transfer at least one direct line of tensional force between the substantially vertical rear-boundary wall and the first sidewall; and a second load-transfer-member adapted to transfer least one direct line of tensional force between the substantially vertical rear-boundary-wall and the second sidewall.

Even further, it provides such a system wherein the deflection limiter further comprises: a third load-transfer-member adapted to transfer a direct line of tensional force between the substantially vertical rear-boundary-wall and the first sidewall, and a fourth load-transfer-member adapted to transfer a direct line of tensional force between the substantially vertical rear boundary-wall and the second sidewall. Moreover, it provides such a system wherein a the direct line of tensional force of the third load transfer-member and the fourth load-transfer-member comprises an angle greater than about 45 degrees with respect to a plane comprising the substantially vertical rear-boundary-wall. Additionally, it provides such a system wherein the deflection limiter further comprises a first forward-load-transfer-member adapted to transfer at least one direct line of tensional force between the first sidewall and such at least one substantially vertical front-boundary-wall; and a second forward-load-transfer member adapted to transfer least one direct line of tensional force between the second sidewall and the substantially vertical rear-boundary-wall.

Also, the present invention provides such a system wherein the substantially vertical rear boundary-wall comprises a passage structured and arranged to pass the flowable material therethrough. In addition, it provides such a system wherein the passage comprises a projecting tubular passage structured and arranged to transfer the flowable-material between the interior chamber and a flowable material receiving apparatus. And, it provides such a system wherein: the projecting tubular passage comprises a chute coupler structured and arrange to securely couple the projecting tubular passage to the flowable material receiving apparatus; and the coupling of the projecting tubular passage to the flowable material receiving apparatus assists in maintaining the projecting tubular passage in a position assisting a flow of the flowable material from the interior chamber.

Further, it provides such a system wherein: the projecting tubular passage comprises a proximal end coupled to the substantially vertical rear boundary-wall and a distal end through which the flowable material is discharged; and the chute coupler comprises a circumferential elastic band circumferentially coupled to the distal end. Even further, it provides such a system further comprising: the flowable material receiving apparatus; wherein such a flowable material receiving apparatus comprises a discharge hopper; wherein the discharge hopper comprises a substantially rigid cabinet comprising a plurality of substantially planer outer walls enclosing a hollow interior, wherein such plurality of substantially planer outer walls comprise a generally trapezoidal-shaped upper wall, a substantially trapezoidal-shaped lower wall, at least one first sidewall, a second sidewall, a forward wall, and a discharge opening; wherein the forward wall comprises a forward aperture structured and arrange to receive the projecting tubular passage; wherein the forward aperture comprises a substantially continuous peripheral flange assembly structured and arranged to support the securing of the projecting tubular passage adjacent the forward aperture by the chute coupler; and wherein the securing of the projecting tubular passage to the forward aperture assists in maintaining the projecting tubular passage in such at least one position assisting the flow of the flowabie material during such discharge from the interior chamber.

Even further, it provides such a system wherein: the generally trapezoidal shaped upper wall comprises a access opening structured and arranged to allow user access to the interior chamber; and the access opening comprises at least one user operable cover structured and arranged to cover the access opening during discharge of the flowable-material.

In accordance with another preferred embodiment hereof, this invention provides a method related to the handling of a flowable-material within a interior of at least one cargo container, such method comprising the steps of: providing within such at least one cargo container, a liner material adapted to separately enclose the flowable-material within the cargo container, wherein the liner material comprises a substantially flexible floor panel; anchoring the separating enclosure within the interior using a anchor strap, tensioning such at least one anchor strap to draw the substantially flexible floor panel substantially within a single geometric plane, whereby discharge of the flowable material from such at least one separating enclosure is assisted by the positioning of the substantially flexible floor panel substantially within such single geometric plane.

In accordance with another preferred embodiment hereof this invention provides a system related to the handling of a flowable material within a interior of at least one cargo containers such system comprising: a separating enclosure adapted to separately enclose substantially the entire volume of the interior of the cargo container; and a plurality of anchor members, each one of such plurality adapted to anchor the separating enclosure within the interior; wherein the separating enclosure comprises a interior chamber adapted to contain the flowable material within the separating enclosure; and wherein a of such plurality of anchor members comprises a tensioning device adapted to generate at least one tensional force between the separating enclosure and the interior.

Even further, it provides such a system wherein: each one of such plurality of anchor members comprises a strap permanently attached to the separating enclosure; and the tensioning device comprises an adjustable buckle.

In accordance with another preferred embodiment hereof, this invention provides a system related to the handling of a flowable material within a interior of at least one cargo container having a longitudinal length and a plurality of anchor points distributed along substantially a full length of the longitudinal length, such system comprising: a separating enclosure adapted to separately enclose substantially the entire volume of the interior of the cargo container; and a plurality of structural anchor members adapted to anchor the separating enclosure to the plurality of anchor points; wherein the separating enclosure comprises a interior chamber adapted to contain the flowable material; wherein a load applied to the separating enclosure is generated by the containment of the flowable material within the interior chamber; and wherein such plurality of structural anchor members comprises a load distributing arrangement adapted to assist in distributing a portion of the load between the plurality of anchor points distributed along substantially a full length of the longitudinal length.

In accordance with another preferred embodiment hereof, this invention provides a system related to a flowable material liner adapted to separately enclose a flowable material within the cargo container, the flowable material liner comprising a tubular discharge passage: a discharge hopper structured and arranged to receive a discharge flow of the flowable material; wherein such a discharge hopper comprises a substantially rigid cabinet; wherein such at least one substantially rigid cabinet comprises a plurality of substantially planer outer walls enclosing a hollow interior; wherein such plurality of substantially planer outer walls comprise a generally trapezoidal-shaped upper wall, a substantially trapezoidal-shaped lower wall, a first sidewall, a second sidewall, at least one forward wall; and, a discharge opening; wherein the forward wall 13 comprises a forward aperture structured and arrange to receive the tubular discharge passage; wherein the forward aperture comprises a substantially continuous peripheral flange assembly structured and arranged to support the securing of the tubular discharge passage adjacent the forward aperture by a coupler device; and wherein such securing of the tubular discharge passage to the forward aperture assists in maintaining the tubular discharge passage in a position assisting the discharge flow of the flowable material during such discharge from the interior chamber.

Even further, it provides such a system wherein: the generally trapezoidal-shaped upper wall comprises an access opening structured and arranged to allow user access to the interior chamber; and the access opening comprises at least one user operable cover structured and arranged to cover the access opening during the discharge of the flowable-material. Moreover, it provides each and every novel feature, element combination, step and/or method disclosed or suggested by this provisional patent application.

DETAILED DESCRIPTION OF THE BEST MODES AND PREFERRED EMBODIMENTS OF THE INVENTION

Figure 1:
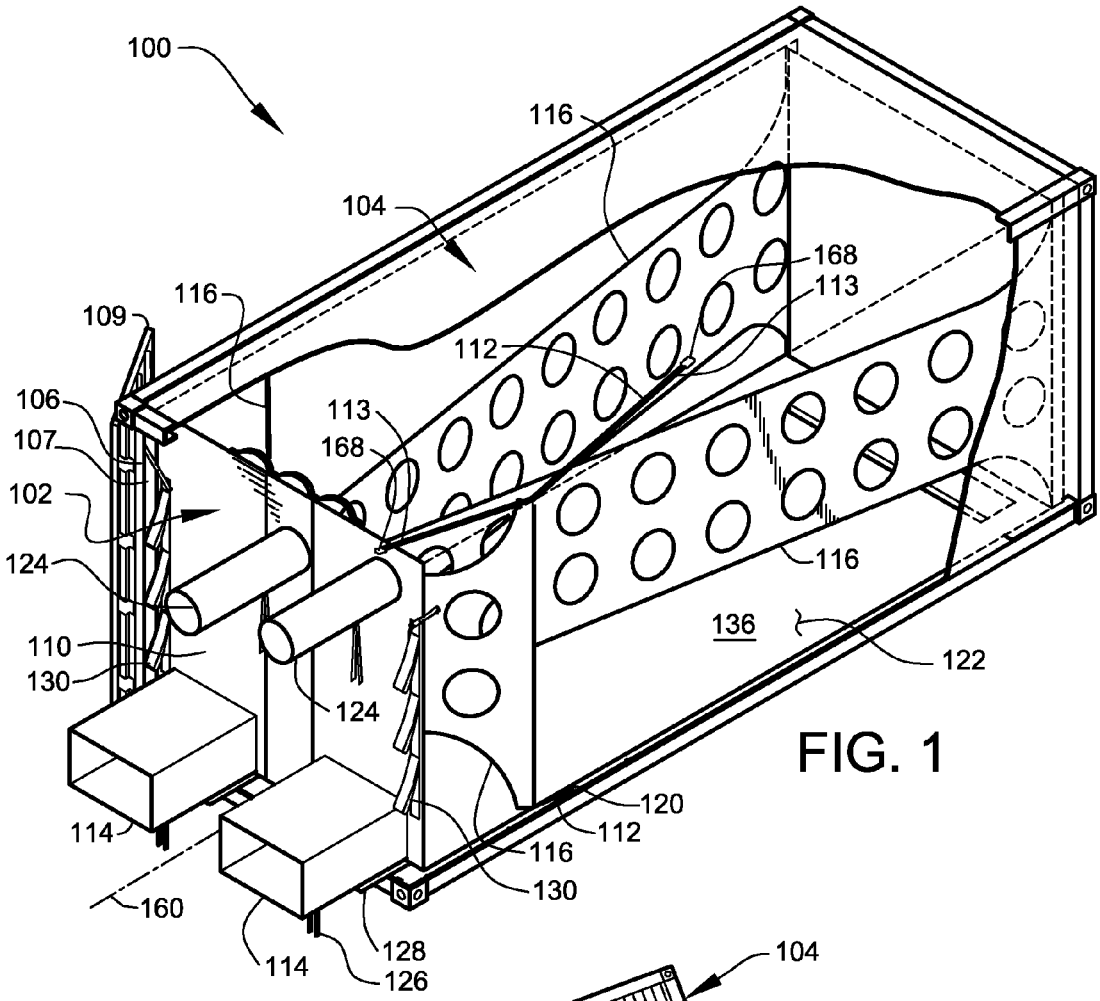
FIG. 1 shows a perspective view, in partial section, illustrating a container liner of a container liner system installed within a shipping container according to a preferred embodiment of the present invention.
Figure 2:
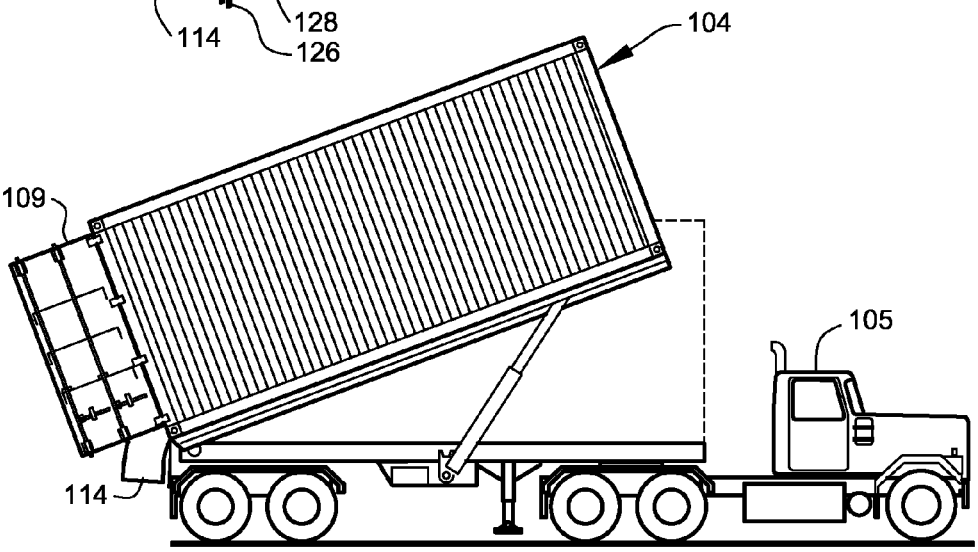
FIG. 2 shows a side view of the shipping container of FIG. 1 in a raised discharge position according to a preferred embodiment of the present invention.

FIG. 1 shows a perspective view, in partial section, illustrating container liner 102 of container liner system 100 installed within shipping container 104 according to a preferred embodiment of the present invention. FIG. 2 shows a side view of shipping container 104 of FIG. 1 in a raised discharge position according to a preferred embodiment of the present invention.

Preferably, container liner 102 comprises a large bag-like structure that generally matches the volume and shape of interior 106 of shipping container 104, as shown. In the present disclosure, shipping container 104 is a hypothetical example of a substantially rigid box-like container used in material transport, including cargo containers conforming to International Organization for Standardization (ISO) criteria. In most preferred embodiments, shipping container 104 does not form a part of the present invention. Typically, such containers comprise a rectangular volume having a length that is substantially greater than the height and width, as shown. Typically, such containers are adapted to be loaded and conveyed on container ships, railroad cars, and overland trucks. At the time of this disclosure, five standard lengths, comprising 20 ft (6.1 m), 40 ft (12.2 m), 45 ft (13.7 m), 48 ft (14.6 m) and 53 ft (16.2 m) are most commonly used. Container capacity is often measured in twenty-foot equivalent units 17 (TEU). A twenty-foot equivalent unit is a measure of containerized cargo capacity equal to one standard 20 ft (length)×8 ft (width) 8×8.5 ft (height). "High cube" containers have a height of 9.5 ft (2.9 m), while half-height containers, which are generally used for heavy loads, have a height of 4.25 ft (1.3 m). The interior 106 of shipping container 104 is typically accessed through rear opening 107, as shown. Typically, rear opening 107 is secured by a pair of swinging doors 109, as shown.

In the first preferred embodiment of FIG. 1 through FIG. 10, shipping container 104 comprises a standard 20 ft (6.1 m) length, as shown. Other highly preferred embodiments are adapted to fit alternate container configurations, preferably 40 ft. (12.2 m) shipping containers, as described below. Preferably, container liner 102 is adapted to fit within interior 106 of shipping container 104, as shown. When so installed, container liner 102 is preferably adapted to provide a secondary storage enclosure separating flowable material 108 from the interior 106 of shipping container 104. This preferably provides a clean and safe environment for the bulk transportation of flowable material 108, as shown.

Preferably, the structures and features of container liner 102 (at least embodying herein at least one separating enclosure adapted to separately enclose the flowable material within the cargo container) are substantially symmetrical about longitudinal line 160, thus, arrangements and features identified within the visible side of the perspective views are applicable to complementary features and arrangements located at the opposite side. Preferably, container liner 102 is secured firmly within interior 106 of shipping container 104 using a distributed arrangement of external tie-down straps 112, as shown (at least embodying herein at least one anchor adapted to anchor the separating enclosure within the interior, and at least embodying herein a external load-transfer-member adapted to transfer a load between the separating enclosure and the cargo container). This preferred arrangement divides loads imposed on container liner 102 between multiple anchor points within shipping container 104, as shown.

Figure 6:
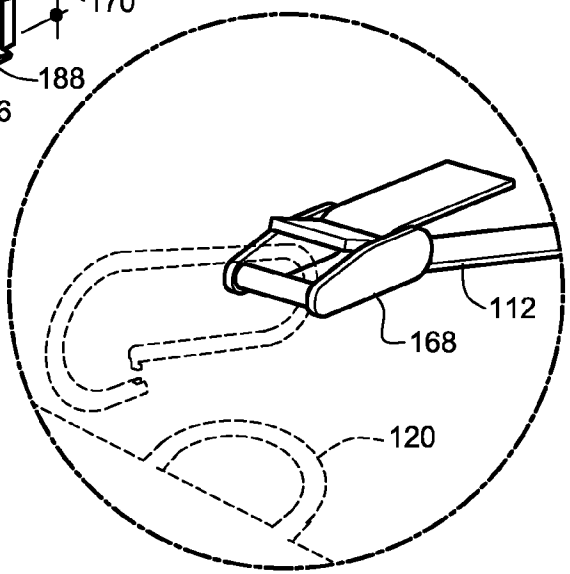
FIG. 6 shows the detailed view 6-6 of FIG. 5A.

Preferably, the distal ends 113 of tie-down straps 112 comprise a strap tensioning devices most preferably a strap tensioning buckle 168 (see FIG. 6). Buckle 168 is preferably adapted to receive a removable anchor device, such as a spring-gated hook or carabineer, which may be supplied as a component of container liner system 100, or as an accessory item that is separately sourced. The anchor device preferably couples tie-down straps 112 to anchor points 120 of shipping container 104, as shown. Such anchor points typically comprise metal loops or apertured plates welded at various points within interior 106, as shown. Coupling the multiple tie-down straps 112 to multiple anchor points 120 within shipping container 104 preferably distributes the cargo load substantially evenly along the length of container liner 102, as shown (at least embodying herein the external load-transfer-member comprises a load divider adapted to assist in dividing the transfer of the load between a plurality of supports within the cargo container).

Figure 3:
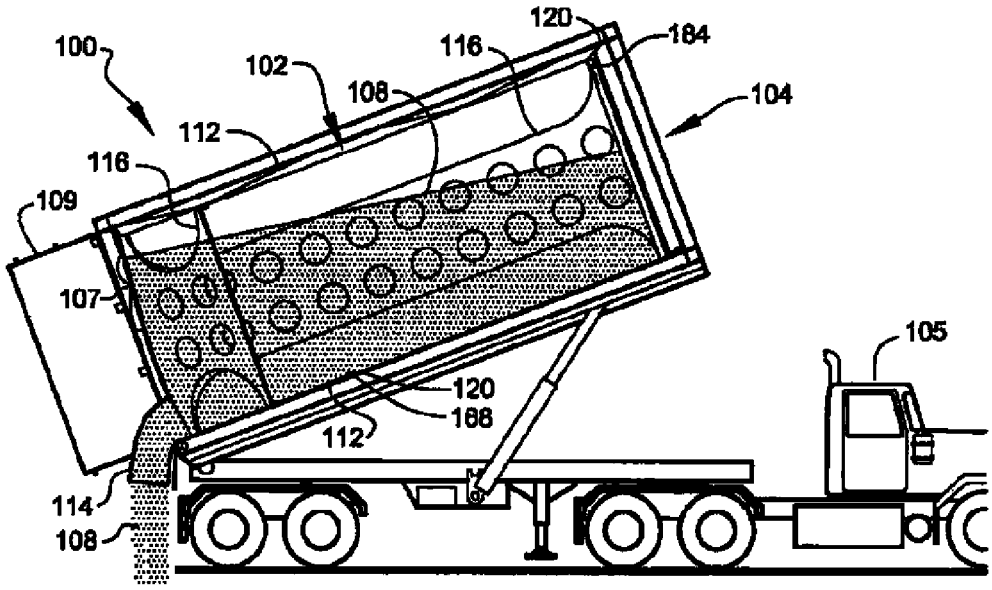
FIG. 3 shows the side view of FIG. 2, in partial section, illustrating the container liner in the process of discharging contained material according to the preferred embodiment of FIG. 1.

Discharge of flowable material 108 from container liner 102 generally involves tipping of shipping container 104, as best shown in FIG. 2 and FIG. 3 of the disclosure. Typically, an articulating support assembly of transport vehicle 105 raises shipping container 104, as shown, shifting flowable material 108 toward discharge chutes 114 located at the rear boundary containment wall, preferably identified herein as rear bulkhead wall 110 (at least embodying herein a substantially vertical rear-boundary-wall). Preferably, tie-down straps 112 securely maintain container liner 102 within interior 106 during the tipping and discharge operation, as shown.

A problem significant within poorly supported container liners is residual product trapped within the liner after discharge. This problem is most frequently the result of the bottom of the liner curling, overlapping and/or creasing during product loading. The result is slow discharge rates and, in many cases several thousand pounds of residual product remaining trapped inside interior 106 of container liner 102. Residual material is typically removed by hand or discarded with container liner, at significant expense.

Preferably, container liner 102 is adapted to reduce the occurrence of folds and creases within lower containment panel 136 (at least embodying herein a substantially horizontal lower-containment-panel) when container liner 102 is installed, loaded, and unloaded. This preferred system feature is enabled by arranging a plurality tie-down straps 112 along the periphery of lower containment panel 136, each tie-down strap 112 connected to an anchor point 120 within interior 106. Preferably, each lower tie-down strap 112 comprises a strap-tensioning buckle 168 that allows an installer to adjustably tension the anchor straps to draw lower containment panel 136 into a substantially flat plane during installation. Preferably, lower tie-down straps 112 are adapted to maintain lower containment panel 136 in such a flattened configuration during tipping and discharge of flowable material 108 from container liner 102, as shown. This preferred feature greatly increases the rate at which flowable material 108 is discharged. Furthermore, this preferred arrangement greatly reduces the amount of flowable material 108 trapped within the interior of the liner, saving both time and money for the operators of the discharge sites (at least embodying herein wherein the substantially horizontal lower-containment-panel comprises a peripheral edge; the peripheral edge comprises the strap; and such tensioning of the strap by the tensioner assists in drawing the substantially horizontal lower containment-panel substantially within a single geometric plane, whereby discharge of the flowable material from the interior chamber is assisted by the positioning of the substantially horizontal lower-containment-wall substantially within such single geometric plane). Thus, in accordance with preferred embodiments of the present invention, there is provided, relating to shipping container liner systems, the above-described method related to the efficient discharge of a bulk flowable-material from within the cargo container, comprising the steps of: providing within the cargo container, at least one liner material adapted to separately enclose the bulk flowable-material within the cargo container, wherein the liner material comprises a substantially flexible floor panel; anchoring the separating enclosure within the interior using a anchor strap, tensioning the anchor strap to draw the substantially flexible floor panel substantially within a single geometric plane, whereby discharge of the flowable material from the separating enclosure is assisted by the positioning of the substantially flexible floor panel substantially within such single geometric plane.

Specific reference is now made to FIG. 3 with continued reference to FIG. 1 and FIG. 2. FIG. 3 again illustrates the side view of FIG. 2, now depicted in partial section, as shown. FIG. 3 diagrammatically illustrates container liner 102 in the process of discharging flowable material 108.

It is common for the bulk weight of flowable material 108 to exceed forty thousand 21 pounds. This weight generates considerable loading on the containment boundaries of container liner 102. In most applications, the inner wall surfaces of shipping container 104 assist in supporting this load, however, rear bulkhead wall 110, which is preferably located adjacent rear opening 107, is substantially unsupported by an interior wall of shipping container 104 (as swinging doors 109 are opened for filling, inspection, discharge, etc.). Additional structural support is therefore required at rear bulkhead wall 110. Preferably, to prevent excessive deflection (bulging), or rupture of rear bulkhead wall 110 under the force of this load, container liner 102 comprises a novel arrangement of supportive internal baffles 116, as shown. Preferably, internal baffles 116 function to limit outward deflection by transferring a substantial portion of the load applied to rear bulkhead wall 110 to other vertical walls within the forward portion of container liner 102, as shown (at least embodying herein wherein the load transfer member does not intersect the substantially horizontal lower containment-panel). This preferred transfer of force is especially important during tipping and discharge, when the loading at rear bulkhead wall 110 is greatest. This preferred support arrangement preferably eliminates the need for conventional steel restraint bars currently required with existing liners.

Figure 4:
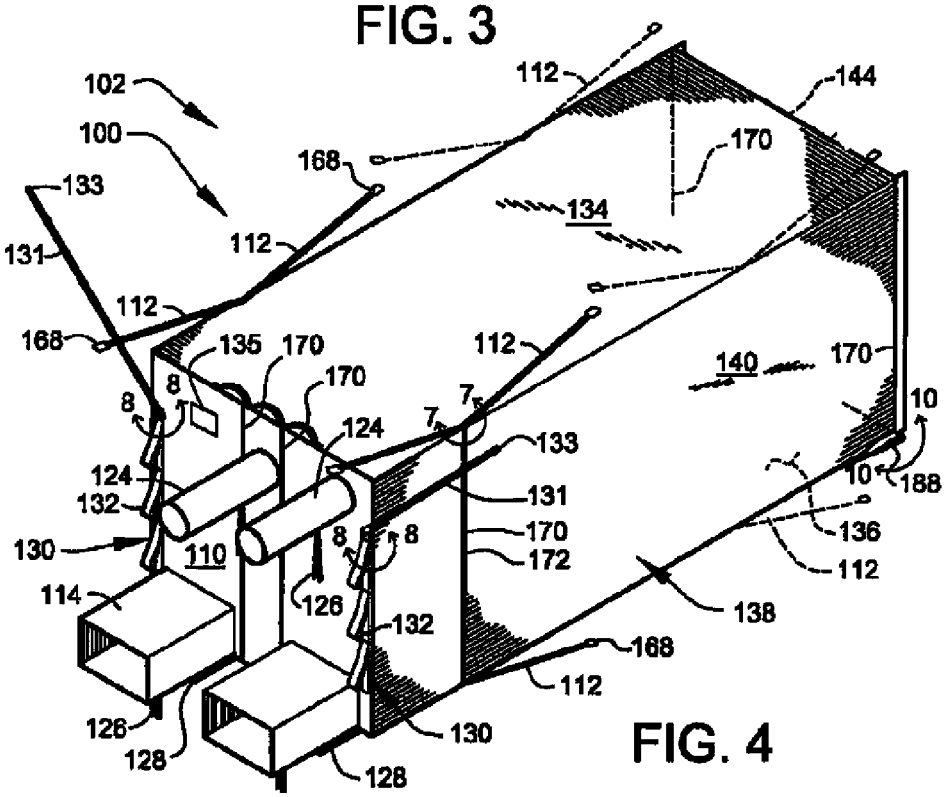
FIG. 4 shows a perspective view illustrating preferred external features of the container liner according to the preferred embodiment of FIG. 1.

FIG. 4 shows a perspective view illustrating preferred external features of container liner 102 according to the preferred embodiment of FIG. 1. Preferably, the shape and size of container liner 102 generally resembles a rectangular prism, closely matching the rectangular internal volume of interior 106. Preferably, container liner 102 fills substantially the entire interior volume of shipping container 104, as shown. Upon reading the teachings of this specification, those of ordinary skill in the art will now understand that, under appropriate circumstances, considering such issues as shipping container shape, intended use, etc., other geometric liner shapes, such as hollow cylindrical shapes, cube shapes, complex shapes formed to fit within special purpose containers, etc., may suffice.

Preferably, container liner 102 comprises rear bulkhead wall 110, upper containment panel 134 (at least embodying herein a substantially horizontal upper-containment panel), lower containment panel 136 (see FIG. 5A), and an arrangement of forward containment walls 138 (at least embodying herein a substantially vertical forward-boundary-wall and at least embodying herein a substantially vertical front boundary-wall). Preferably, the forward containment walls 138 comprise right sidewall 140, left sidewall 142 (at least embodying herein a substantially vertical side-boundary-wall), and forward bulkhead 144, as shown.

Preferably, rear bulkhead wall 110, upper containment panel 134, lower containment panel 136, and forward containment walls 138 are permanently inter-joined to form a substantially unitary enclosure comprising an interior chamber suitable for holding one or more flowable materials 108 (at least embodying herein wherein the separating enclosure comprises a interior chamber adapted to contain the flowable material within the separating enclosure, and wherein both the substantially vertical rear-boundary-wall and the substantially vertical forward boundary-wall adjoin the substantially horizontal upper-containment-panel and the substantially horizontal lower-containment-panel). Preferably, rear bulkhead wall 110 comprises an arrangement of passages adapted to provide access to interior chamber 122 of container liner 102 (see FIG. 5A below). Preferably, rear bulkhead wall 110 comprises a, preferably two upper fill chutes 124 and at least one, preferably two lower discharge chutes 114, as shown.

Preferably, upper fill chutes 124 are used to fill interior chamber 122 with flowable material 108, while lower discharge chutes 114 are used to discharge flowable material 108 from interior chamber 122. Preferably, upper fill chutes 124 and lower discharge chutes 114 are constructed of a material similar to that of container liner 102. Preferably, upper fill chutes 124 and lower discharge chutes 114 are permanently joined to rear bulkhead wall 110, as shown. Preferably, both upper fill chutes 124 and lower discharge chutes 114 comprise a closure device, preferably comprising chute ties 126 that are preferably adapted to tie-off and seal the chutes during transport. In addition, port covers 128 are provided as a protective cover for lower discharge chutes 114 during transport. Preferred embodiments of rear bulkhead wall 110 preferably comprise additional features, such as inspection port 135 to assist inspection of interior chamber 122, as shown. Upon reading the teachings of this specification, those of ordinary skill in the art will now understand that, under appropriate circumstances, considering such issues as intended use, cargo type, etc., other bulkhead arrangements, such as, for example, full access doors, identification indicia, tracking devices/monitors, etc., may suffice. In existing liners, the size and placement of chutes are limited by the need to support the rear wall with a plurality of horizontal bars. By eliminating the bar supports container liner system 100 preferably provides a greater number of potential chute configurations. Preferably, both upper fill chutes 124 and lower discharge chutes 114 comprise physical dimensions most appropriate to facilitate loading an unloading of most bulk cargos. For example, both upper fill chutes 124 and lower discharge chutes 114 of example container liner 102 comprise a projecting length of about one meter (about 39 inches). Preferably upper fill chutes 124 comprise a diameter of about 300 cm. Preferably, lower discharge chutes 114 comprise a width dimension of about 750 cm and a height dimension of about 450 cm.

Upon reading the teachings of this specification, those of ordinary skill in the art will now understand 24 that, under appropriate circumstances, considering such issues as intended use, cost, nature of cargo, etc., other chute arrangements, such as, for example, alternate quantities, shapes, sizes. etc., may suffice. Furthermore, upon reading the teachings of this specification, those of ordinary skill in the art will now understand that, under appropriate circumstances, considering such issues as intended use, container design, nature of cargo, etc., other chute locations, such as, for example, providing fill chutes located within the top of the liner, side, front bulkhead, etc., may suffice.

Preferably, three elastic loops 121 are centered over rear bulkhead wall 110, as shown. Preferably, elastic loops 121 function as upper rear supports to assist in maintaining proper positioning of bulkhead wall 110. Preferably, elastic loops 121 are formed from a band of elastic webbing permanently attached, most preferably sewn to the upper peripheral edge of upper containment panel 134, as shown.

Although container liner 102 does not require the use of rear horizontal support bars, accommodations are provided for their use. Preferably, rear bulkhead wall 110 comprises a set of looped bar straps 130 adapted to support the conventional use horizontal support bars (at least embodying herein wherein the separating enclosure further comprises a restraint-bar supporter adapted to assist in supporting a restraint bar in a position assisting restraint of the substantially flexible material against movement). This preferred feature permits the use of container liner system 100 where rules and regulations demand the use of bars, or during the transporting of cargo having an unusually heavy weight. Preferably, bar support loops 132 of looped bar straps 130 are purposefully extended in length to span the distance between rear bulkhead wall 110 and the bar-end engagement slots located adjacent rear opening 107.

Figure 8:
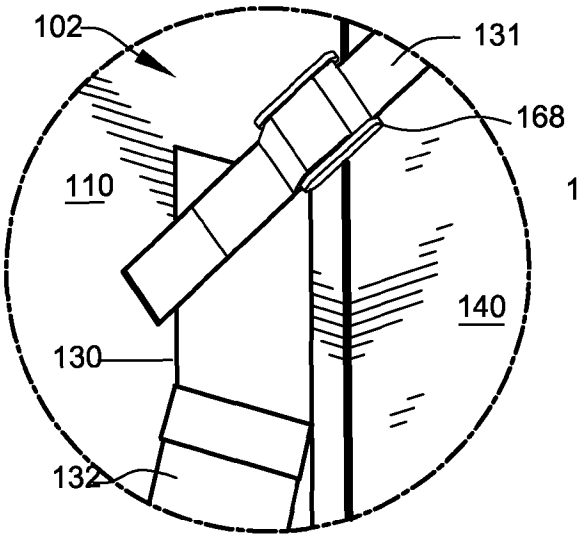
FIG. 8 shows the detailed view 8-8 of FIG. 5A.

Referring to detailed view 8-8 of FIG. 8, container liner 102 comprises an additional set of rear tie-straps 131, as shown. Preferably, a single rear tie-strap 131 is permanently attached, preferably sewn, to the upper end of the right and left looped bar straps 130, as shown. Preferably, each rear tie-strap 131 comprises a strap-tensioning buckle 168, as shown (at least embodying herein wherein the strap comprises a tensioner adapted to generate a tensional force between the first strap-end and such at least one second strap-end). Preferably, the distal end 133 of each rear tie-strap 131 is provided with a loop adapted to receive a removable anchor device such as a spring-gated hook or carabineer (which may be supplied as a component of container liner system 100, or as an item that is separately sourced). Preferably, the anchor device firmly couples each rear tie-strap 131 to an anchor point 120 within shipping container 104. Preferably, rear tie-strap 131 functions to adjustably support the positioning of looped bar straps 130 and to further assist in controlling the shape, deflection, and support of rear bulkhead wall 110, as shown.

Figure 5B:
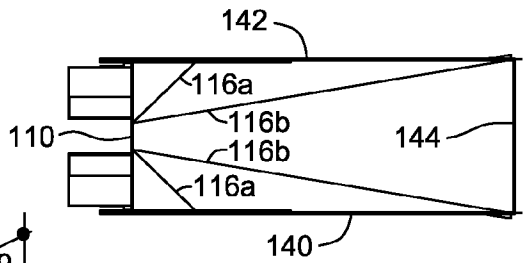
FIG. 5B shows a top view, in partial section, of the container liner in FIG. 1, illustrating preferred internal features and arrangements.
Figure 5A:
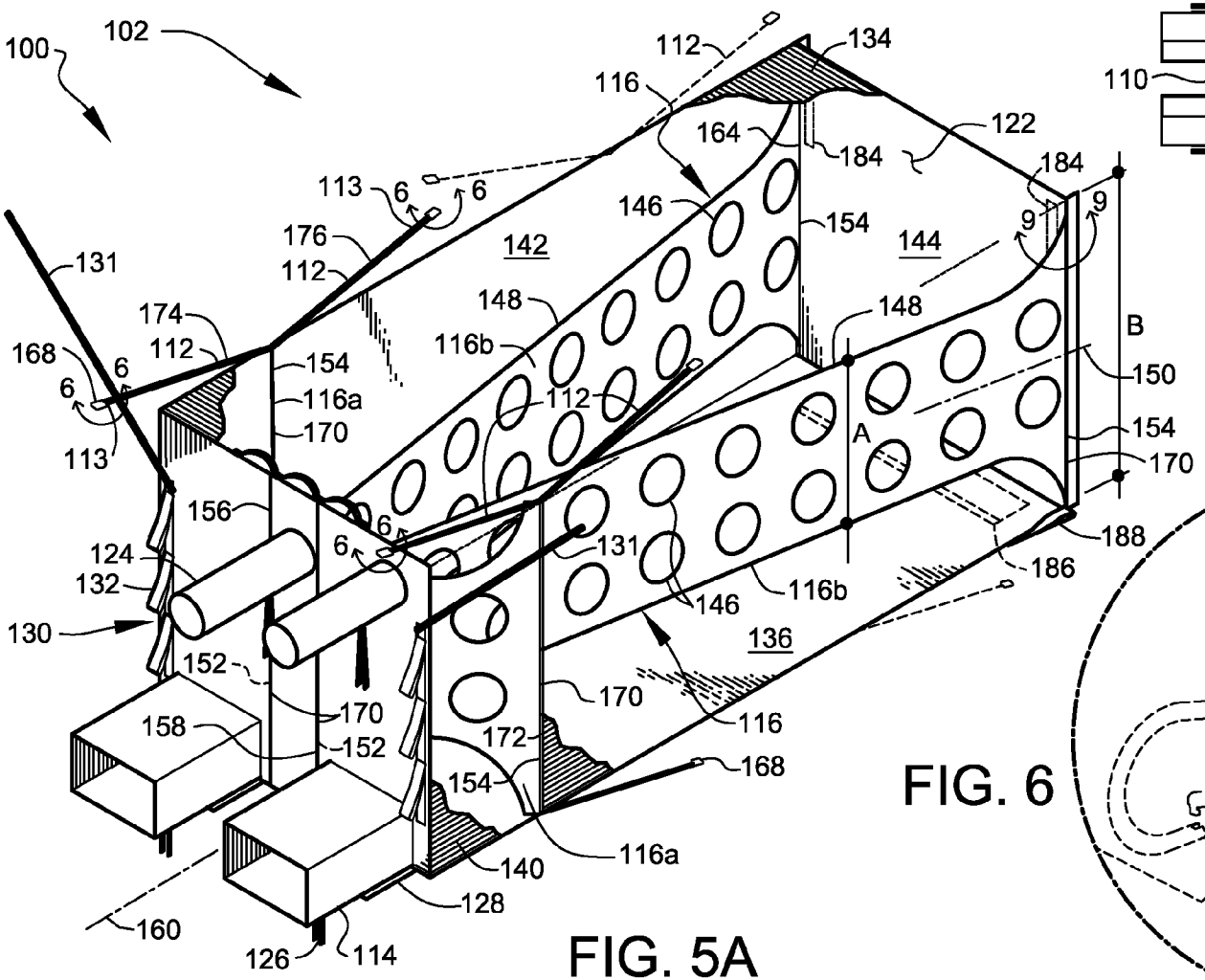
FIG. 5A shows a perspective view, in partial cutaway., of the container liner in FIG. 1, illustrating preferred internal features and arrangements.

FIG. 5A shows a partial cutaway perspective view of container liner 102, illustrating preferred internal features and arrangements of container liner 102. FIG. 5B shows a top view, in partial section, of container liner 102 of FIG. 1. Upper containment panel 134 and right sidewall 140 have been deleted from the view to assist in clearly depicting the preferred interior arrangements of container liner 102.

As previously described, internal baffles 116 function as force transfer members to transfer loads from rear bulkhead wall 110 to points within vertically oriented forward containment walls 138, as shown. Preferably, each internal baffle 116 comprises a flexible panel having an extended length and substantial width, as shown. Preferably, each internal baffle 116 comprises an elongated planar panel that is generally symmetrical about longitudinal axis 150, as 26 shown (at least embodying herein a deflection limiter adapted to limit deflection of the substantially vertical rear-boundary-wall under a load imposed by the flowable material during such containment within the separating enclosure, wherein the deflection limiter comprises a load transfer member adapted to transfer least one direct line of tensional force between the substantially vertical rear-boundary-wall and the substantially vertical forward boundary-wall).

In the preferred embodiment, mid portion 148 of internal baffle 116 comprises a substantially uniform width, as shown. Therein, each end of internal baffle 116 terminates by sweeping away from longitudinal axis 150 along opposing arcs to terminate in wide attachment ends identified herein as attachment end 152 and attachment end 154 (at least embodying herein wherein such at least one load transfer member comprises a rear-boundary-wall end and a forward-boundary-wall end). Preferably, mid portion 148 comprises a vertical width A equal to about one half the interior height B of interior 106, as shown. Preferably, attachment ends 152 each comprise a width about equal to interior height B, as shown.

Figure 15:
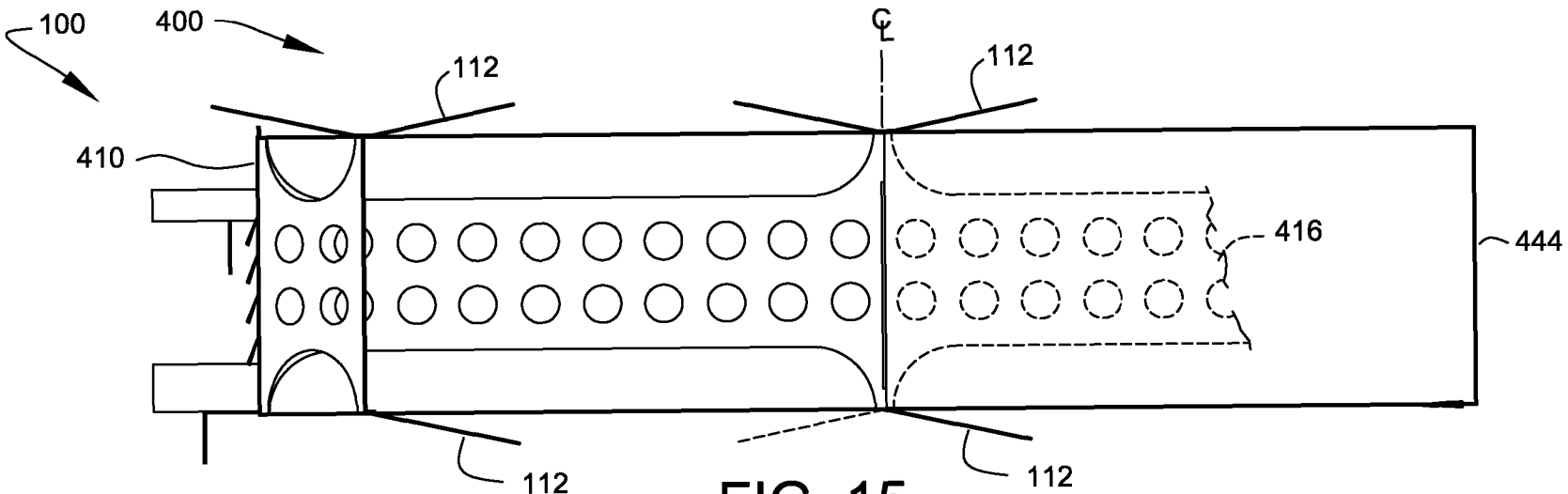
FIG. 15 shows a side view, in partial section, of an alternate container liner according to another preferred embodiment of the present invention.
Figure 16:
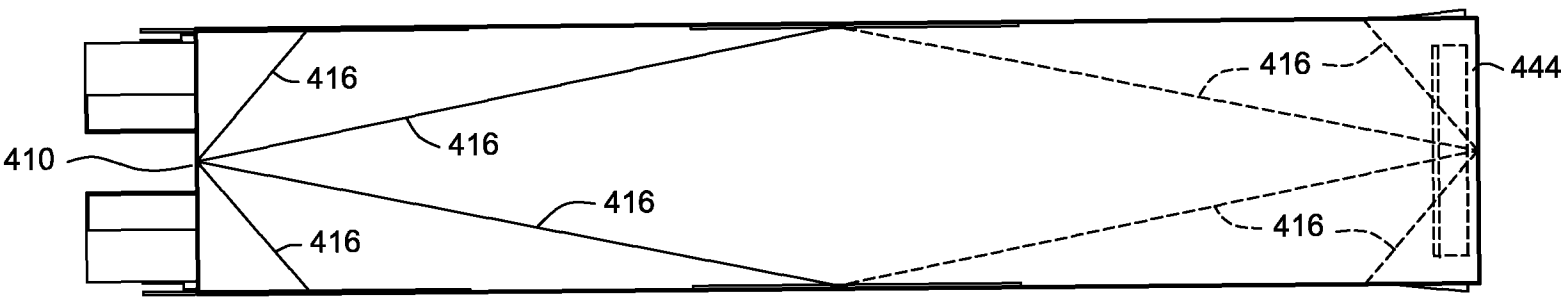
FIG. 16 shows a top view, in partial section, of the alternate container liner of FIG. 15.

Preferably, attachment end 152 of each internal baffle 116 is directly joined to rear bulkhead wall 110, preferably along one of two substantially parallel and substantially vertical lines of attachment identified herein as rear attachment line 156 and rear attachment line 158, as shown (at least embodying herein wherein the rear-boundary-wall end comprises at least one rear attacher adapted to attach the rear boundary-wall-end to such at least one substantially vertical rear-boundary-wall). It should be noted that preferred embodiments of container liner system 100 comprise a single line of rear attachment as illustrated in FIG. 15 and FIG. 16. Preferably, rear attachment line 156 and rear attachment line 158 are oriented generally perpendicular to lower containment panel 136 and are located anywhere from a third to half way (for single lines of attachment) across the width of the rear bulkhead wall 110, as shown.

In the preferred embodiment, container liner 102 comprises at least two internal baffles 116 positioned symmetrically about longitudinal line 160, as shown. More preferably, container liner 102 comprises at least four internal baffles 116 comprising symmetrical disposed pairs identified herein as internal baffles 116*a* and internal baffles 116*b*, as shown (at least embodying herein wherein the deflection limiter comprises more than two load transfer members each adapted to transfer a direct line of tensional force between the substantially vertical rear-boundary-wall and the substantially vertical forward boundary-wall). Preferably, internal baffles 116*a* and internal baffles 116*b* comprise an arrangement of short and long relative lengths to assist in distributing the load imposed on rear bulkhead wall 110 throughout the forward portions of container liner 102, as shown.

Therein, a first internal baffle 116*a* is joined to rear bulkhead wall 110 at rear attachment line 156 and extends forward at an angle of about 45 degrees relative to rear bulkhead wall 110 to attach to left sidewall 142, as shown (at least embodying herein -wherein such at least one forward boundary-wall-end comprises a forward attacher adapted to attach such at least one forward boundary-wall-end to the substantially vertical forward boundary-wall) Preferably, a second internal baffle 116*a*, which is positioned opposite, is joined to rear bulkhead wall 110 at rear attachment line 158 and extends forward at an angle of about 45 degrees to attach to right sidewall 140, as shown (at least embodying herein wherein the forward boundary-wall-end comprises a forward attacher adapted to attach the forward boundary-wall-end to the substantially vertical forward-boundary-wall). Preferably, an internal baffle 116*b* is joined to rear bulkhead wall 110, also at rear attachment line 156, and extends forward to attach to the left peripheral edge 164 of forward bulkhead 144, as shown (at least embodying herein wherein the forward boundary-wall-end comprises a forward attacher adapted to attach the forward boundary-wall-end to the substantially vertical forward-boundary-wall).

In the preferred embodiment, internal baffle 116*b* extends along a line greater than 45 degrees relative to rear bulkhead wall 110, as shown (at least embodying herein wherein the direct line of tensional force of the load transfer member comprises an angle greater than 45 degrees with respect to a plane comprising the substantially vertical rear-boundary wall). This preferred arrangement distributes loads well forward within the liner, as shown. Therein, a second opposing internal baffle 116*b* is joined to rear bulkhead wall 110 at rear attachment line 158 and extends forward to attach to the right peripheral edge 166 of forward bulkhead 144, as shown (at least embodying herein wherein the forward boundary wall-end comprises a forward attacher adapted to attach the forward boundary-wall-end to the substantially vertical forward-boundary-wall).

Preferably, the second internal baffle 116*b* also extends along a line greater than 45 degrees relative to rear bulkhead wall 110 to distribute forces to the forward portions of the liner, as shown (at least embodying herein wherein the load transfer member comprises an angle greater than 45 degrees with respect to the substantially vertical rear boundary-wall). Also, note that internal baffles 116 engage only vertical walls of the liner to avoid the direct application of transmitted loads on lower containment panel 136, thus assisting in maintaining lower containment panel 136 in a flat configuration. Upon reading the teachings of this specification, those of ordinary skill in the alt will now understand that, under appropriate circumstances, considering such issues as user preference, intended use, design preference, etc., other anchoring arrangements, such as attaching both internal baffles to opposing sidewalls, etc., may suffice.

Herein, attachment end 152 and attachment end 154 of each baffle is attached to its respective bulkhead and containment wall along a substantially continuous line of attachment identified herein as baffle seam 170, as shown. Preferably, baffle seam 170 is oriented substantially perpendicular to lower containment panel 136. Preferably, these substantially continuous lines of attachment each comprise an attachment length substantially equal to interior height B (extending the vertical distance between upper containment panel 134 and lower containment panel 136), as shown. This preferred arrangement of extended length attachments further assist in evenly distributing the loads developed at the bulkheads throughout the structure of container liner 102. The above-described attachment arrangements of internal baffles 116 at least embodying herein wherein the rear attacher comprises a rear attachment-length; the forward attacher comprises a forward attachment length; and the rear attachment-length and the forward attachment length are each oriented substantially perpendicular to the substantially horizontal lower-containment-panel.

In the preferred embodiment each baffle 116 is permanently attached to its respective bulkhead or containment wall, preferably by mechanical fastening, most preferably by sewing. Baffle seam 170 is reinforced by the application of a vertical band of applied webbing identified herein as baffle seam strap 172, as shown. Preferably, baffle seam strap 172 is applied to the exterior face of container liner 102, as shown, and functions to reduce the tendency of internal baffles 116 to tear away from the containment wall under high loads. Upon reading the teachings of this specification, those of ordinary skill in the art will now understand that, under appropriate circumstances, considering such issues as user preference, intended use, etc., other attachment methods, such as chemical bonding, heat bonding, etc., may suffice.

Preferably, internal baffles 116 are constructed from a durable material having suitable mechanical properties including appropriate tensile strength. Internal baffles 116 comprise an arrangement of apertures 146 to permit passage of flowable material 108 during loading and discharge. Apertures 146 are preferably round in shape to reduce, stress points within internal baffles 116 under load. Upon reading the teachings of this specification, those of ordinary skill in the art will now understand that, under appropriate circumstances, considering such issues as intended use, nature of cargo, etc., other aperture arrangements, such as, for example, ovals, elongated slots, the use of baffles without apertures, etc., may suffice. Preferably, the loads transferred by internal baffles 116 are subsequently transferred out to shipping container 104 by an arrangement of tie-down straps 112, as shown. Preferably, tie-down straps 112 are positioned directly over and directly under the centerline 182 of baffle seam 170, as best illustrated in FIG. 7A. Preferably tie-down straps 112 are permanently attached to the outer faces of upper containment panel 134 and lower containment panel 136, preferably by mechanical fastening with sewing being most preferred.

Figure 7B:
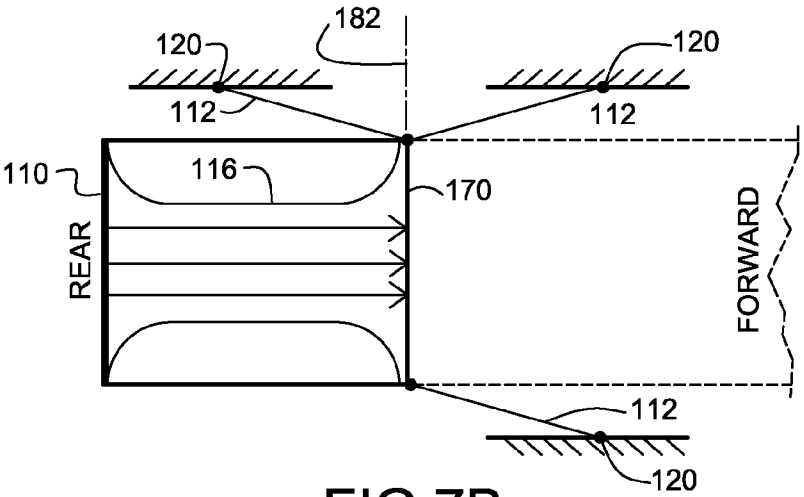
FIG. 7B shows a diagram illustrating the transfer of load forces through the container liner embodiments according to preferred embodiments of the present invention.
Figure 7A:
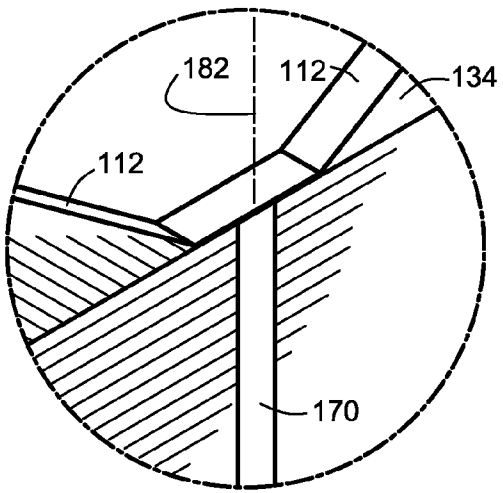
FIG. 7A shows the detailed view 7-7 of FIG. 5A.

FIG. 7B shows a diagram illustrating the transfer of load forces through preferred embodiments of container liner system 100. Preferably, internal baffles 116 function as force transfer members to transfer loads from rear bulkhead wall 110 to baffle seam 170 of forward containment wall 138, as shown. From baffle seam 170, the load forces are preferably transferred, in a substantially direct manner, to upper and lower tie-down straps 112, as shown. Preferably, the force loads are then directed to anchor points 120, of shipping container 104, as shown. This highly preferred arrangement efficiently moves the load forces through the structural elements of the liner, as shown.

Figure 7C:
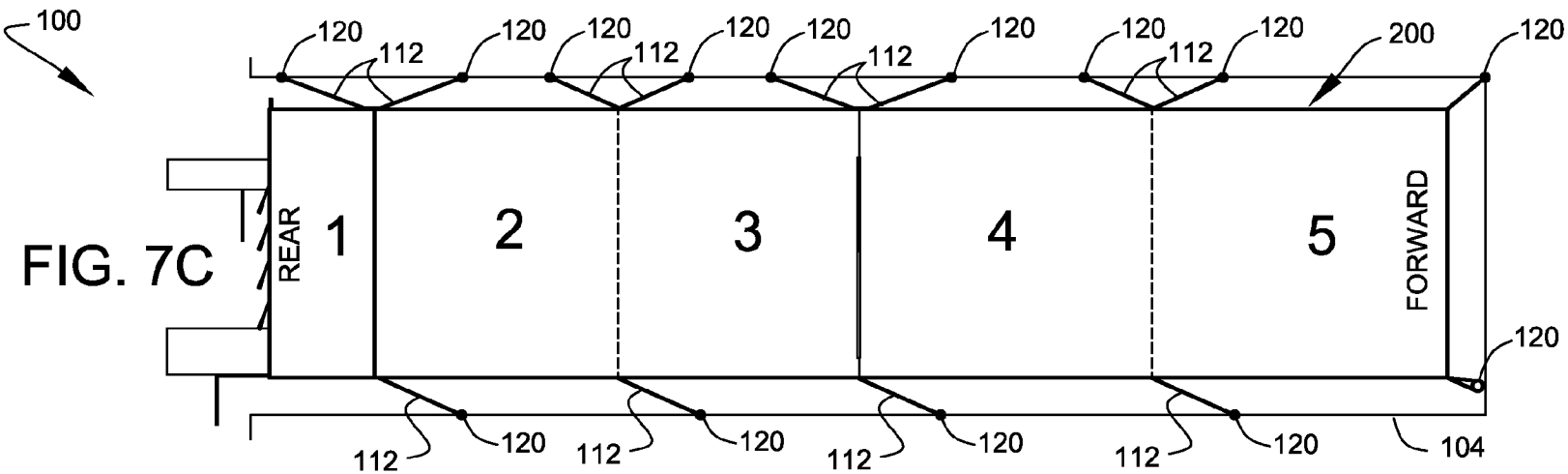
FIG. 7C shows a diagram illustrating the subdividing of loads within the container liner according to preferred embodiments of the present invention.

FIG. 7C shows a diagram illustrating the subdividing of loads within preferred container liner embodiments of the present invention. To assist in illustrating preferred principals of container liner system 100, the diagram of FIG. 7C utilizes an extended liner similar to alternate container liner 200 of FIG. 11A. (Alternate container liner 200 preferably accommodates the internal configurations of a shipping container 104 comprising a length of about 40 feet).

Referring now to FIG. 7C, with continued reference to FIG. 5A through FIG. 7B, tie-down straps 112 are preferably spaced along the horizontal upper and lower peripheral edges of upper containment panel 134 and lower containment panel 136, respectively, as shown. Preferably, tie-down straps 112 distribute the weight evenly along substantially the entire length of container liner 102, so that the weight inside container liner 102 is not dependent on a small number of hooks and bars securing the liner to the front end of the container, and a few bars securing the liner at the rear end of the container. Thus, the load of the liner is preferably subdivided into a plurality of supported regions, as shown.

Although the entire liner envelope contributes, in small part, to the overall support of flowable material 108, a substantial portion of each supported region is structurally supported substantially independently of all other regions, as shown. In generalized terms, the front anchors are substantially responsible for the weight of the product from the forward anchor points to about the first set of tie-down straps (generally defined as region 5). The first tie-downs are substantially responsible for the weight of the product between their placement and the next set of tie-downs (generally defined as region 5), and so on until, at the rear of the container, all the weight has been supported (at least embodying herein the external load-transfer-member comprises a load divider adapted to assist in dividing the transfer of the load between a plurality of supports within the cargo container and further embodies herein a first strap-end and a second strap-end). Upon reading the teachings of this specification, those of ordinary skill in the art will now understand that, under appropriate circumstances, considering such issues as intended use, cargo weight, etc., other anchor strap arrangements, such as, for example, using additional sets of structural tie-down straps as necessary for additional strength, etc., may suffice.

In the preferred embodiment, to further assist in distributing loads, each upper tie-down strap 112 comprises two distal ends 113 identified herein as rear-projecting strap end 174 and forward-projecting strap end 176, as shown (at least embodying herein the external load-transfer member comprises a load divider adapted to assist in dividing the transfer of the load between a plurality of supports within the cargo container and further embodies herein a first strap-end and a second strap-end). Preferably, rear projecting strap end 174 and forward-projecting strap end 176 each project outwardly from a common attachment point located at the outer face of upper containment panel 134, as best shown in FIG. 7A. Preferably, each lower tie-down strap 112 adjacent lower containment panel 136 comprises a single forward-projecting strap end 176; however, two-way strap embodiments matching the upper tie-down straps 112 are preferred in heavy-cargo applications.

FIG. 6 shows the detailed view 6-6 of FIG. 5A illustrating the strap-tensioning buckles 168 of tie-down straps 112. Preferably, buckles 168 allow the installer to selectively tension the tie-down straps 112 thus controlling the manner in which container liner 102 is anchored within shipping container 104, as further described below. Preferably, buckles 168 comprise commercially available webbing hardware with cam-type locking operations preferred.

Upon reading the teachings of this specification, those of ordinary skill in the art will now understand that, the unique structures and arrangements of tie-down straps 112 preferably serve at least three principal functions: they distribute the product weight equally between the individual tie-down straps, located at varying distances on both the top and bottom sides along the length of container liner 102; they eliminate the wrinkles and "fold-overs", that slow down the discharge process; and they enhance safety during the filling, shipping, and discharge process.

Figure 9:
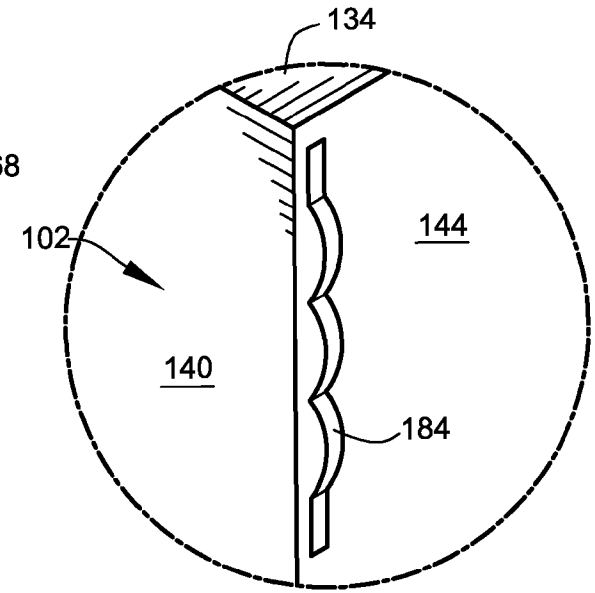
FIG. 9 shows the detailed view 9-9 of FIG. 5A.

Refer now to the forward containment walls 138, specifically to the attachment arrangements adjacent forward bulkhead 144, and specifically to the detailed view 9-9 of FIG. 5A and the detailed view 10-10 of FIG. 5A. Preferably, as best shown in FIG. 9, the upper corners of forward bulkhead 144 comprise front support strap 184, as shown. Front support straps 184 preferably comprise a length of webbing forming three or more loops, as shown. Preferably, each front support strap 184 is permanently attached, more preferably sewn, to the external face of forward bulkhead 144, as shown. Front support straps 184 preferably function as upper support points in the anchoring of container liner 102 within shipping container 104. Loops formed in front support strap 184 are preferably adapted to directly engage forward anchor points 120 of shipping container 104 or, indirectly engage forward anchor points 120 using an appropriate anchor device.

Figure 10:
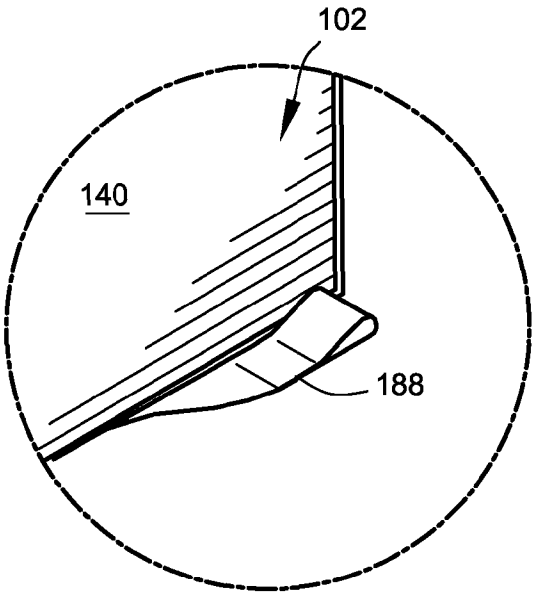
FIG. 10 shows the detailed view 10-10 of FIG. 5A.

In the preferred embodiment, container liner 102 is adapted to utilize a single forward anchor bar as a preferred means for securing container liner 102 within shipping container 104 when shipping heavy flowable materials 108. Herein, lower containment panel 136 comprises bar sleeve 34 186, as shown. Also, bar sleeve 186 is permanently attached, preferably sewn, to the underside of lower containment panel 136, as shown. Herein, bar sleeve 186 comprises a flattened tubular structure adapted to receive a steel anchor bar of the type conventionally used in the anchorage of container liners. Preferably, each forward corner of lower containment panel 136 comprises a bar strap 188, as best shown in FIG. 10. Herein, each bar strap 188 is similarly adapted to receive one end of the above-described steel anchor bar. Also, each bar strap 188 is permanently attached, preferably sewn, within the seam joining lower containment panel 136 and the adjacent sidewalls, as shown. Together, bar sleeve 186 and bar straps 188 provide a means for securing the front of container liner 102 using a single front-mounted steel anchor bar (at least embodying herein wherein the separating enclosure further comprises a restraint-bar supporter adapted to assist in supporting at least one restraint bar in a position assisting restraint of the substantially flexible material against movement).

Container liner 102 is preferably constructed from a substantially flexible and durable material with woven polypropylene (PP) or woven polyethylene (PE) material being preferred. The weight and strength of the preferred fabric is selected based on anticipated cargo load with rear bulkhead wall 110, right sidewall 140, and left sidewall 142 generally comprising a heavier material than the upper, lower, and forward bulkhead panels. Preferred embodiments of container liner 102 are laminated with a sheet of polyethylene or other plastic material as an added membrane adapted to limit the transmission of moisture through the containment boundary.

A preferred woven polypropylene material suitable for use in the construction of upper containment panel 134, lower containment panel 136, and forward bulkhead 144 comprises a 35 material weight of about 95 gm per square meter. A preferred woven polypropylene material suitable for use in the construction of rear bulkhead wall 110, right sidewall 140, and left sidewall 142 comprises a material weight of about 220 gm per square meter. It should be noted that rear bulkhead wall 110 most preferably comprises an additional interior lamination of lightweight woven sheet material to provide additional structural reinforcement to the rear containment boundary. For example, preferred embodiments of rear bulkhead wall 110 comprise an outer layer of woven polypropylene material comprises as material weight of about 220 gm per square meter assembled adjacent an inner layer of woven polypropylene material comprises a material weight of about 95 gm per square meter. Upon reading the teachings of this specification, those of ordinary skill in the art will now understand that, under appropriate circumstances, considering such issues as intended use, nature of cargo, etc., other panel arrangements, such as, for example, constructing the rear bulkhead and side walls as a single continuous panel, etc., may suffice.

In the preferred embodiment, internal baffles 116 are constructed from a durable material having suitable mechanical properties including appropriate tensile strength. Most preferably, for economy of construction, the material of internal baffles 116 comprises substantially the same flexible material used for the enveloping walls and bulkheads. A preferred woven polypropylene material suitable for use in the construction of internal baffles 116 comprises a material weight of about 95 gm per square meter. Most preferably, the material of upper fill chutes 124 and discharge chutes 114 are constricted from a similar woven polypropylene material comprising a material weight of about 95 gm per square meter. Herein, all strapping and webbing are of heavy structural composition, preferably comprising woven flat webbing, most preferably nylon webbing having a minimum width of about 25 mm.

The unique structures and arrangements of container liner 102 require the installer to follow a specific sequence of steps when installing container liner 102 within shipping container 104. In the following description, it is helpful to again referred to FIG. 1, as well as the teachings of the remaining figures. In addition, Appendix A, included herein, contains a photographic depiction of the preferred installation steps. In an initial preferred installations step, a folded container liner 102 is placed on the interior floor of shipping container 104 adjacent rear opening 107. Herein, container liner 102 is packaged to unfold as the installer pulls container liner 102 toward the front of shipping container 104. The installer next secures container liner 102 to the front of shipping container 104 by placing a steel bar through the right and left bar straps 188 and bar sleeve 186, prior to securing the steel bar to the forward end of shipping container 104. In a subsequent preferred step, the installer engages fastening devices, such as a snap hook, within one of the three loops of both the right and left front support straps 184. Next, preferably using the snap hooks, the installer secures the upper portion of container liner 102 to anchor points 120 located at the upper front corners of shipping container 104. The installer has now completed the securing of the front portion of container liner 102 to shipping container 104 and now has two preferred methods with which to complete the installation. In the first preferred procedure, after securing the front of the liner to the front of the container, the upper and lower tie-down straps 112 located on each side of container liner 102 are secured to shipping container 104. Preferably, beginning with the forward-most tie-down straps 112, each tie-down strap 112 is attached (using an appropriate fastening device) to an adjacent anchor point 120 located along the top and bottom sides of shipping container 104 preferably nearest the rear of the forward-most tie-down straps 112). In this preferred step, the rear-projecting strap ends 174 of the most forward tie-down straps 112 are coupled to the closest available anchor points 120 on the sides of the container (generally toward the rear of the container). Then, the installer draws each rear-projecting tie-down strap 174 through its respective buckle 168, until container liner 102 has been drawn tight between the front anchor points and the anchor point 120 on which the now tension rear-projecting tie-down strap 174 is connected. Next, forward-projecting strap end 176 of the same tie-down strap 112 is coupled to an adjacent forward anchor point 120 and is drawn tight. This process is repeated with each tie-down; strap 112, starting with the upper or the lower tie-downs, preferably progressing front to back.

Once both the rear and the forward portions of tie-down strap 112 have been attached and pulled tight, container liner 102 has achieved a condition of proportional weight distributions. In this preferred condition, the weight of flowable, material 108 is distributed between many sets of tie-down straps 112 connection points.

A second preferred method of securing tie-down straps 112 to produce equal weight distribution is to hook the loops located in the back corners of container liner 102 to an accessory buckle and strap system that preferably hooks onto the back of the container. When these accessory straps have been pulled tight, container liner 102 tightens from front to rear eliminating the need to draw the rear-projecting strap ends 174 of tie-down straps 112 tight before tightening the forward-projecting strap ends 176 along the upper and lower sides of the liner. After the forward-projecting strap ends 176 are tightened, the accessory buckle and strap system originally used to tighten container liner 102 from front to rear can, if desired, be removed.

As previously described, attachment end 152 of each internal baffle 116 is directly joined to rear bulkhead wall 110, preferably along one of two substantially parallel and substantially vertical lines of attachment identified herein as rear attachment line 156 and rear attachment line 158, as shown. Despite the effective use of baffles to restrain rear bulkhead wall 110 against outward deflection, rear bulkhead wall 110 still exhibits some outward bulging (in the space between the sides of the liner and the generally vertical line where internal baffle 116 is sewn to rear bulkhead wall 110). To prevent the outward deflection from extending to rear opening 107 and interfering with the operation of swinging doors 109, container liner 102 is preferably constructed to comprise an overall liner length somewhat shorter than the length of the interior of container shipping container 104. Generally, this "hold-back" distance is preferably equivalent to about 5% of the overall linear length of the liner.

In the preferred embodiment, specific hold-back distances are determined through physical field testing and measurement. Alternately, the hold-back distance is calculated by modeling the system to determine (through structural calculation) the degree to which the rear bulkhead wall deflects under the surcharge of the contained flowable material. For example, the deflection of the rear wall of container liner 102 under load may be calculated by estimating the loading of flowable material 108 applied across the rear wall of container liner 102. In general, this calculation assumes the greatest loading to occur as the liner is tilted during unloading (although live loads and similar dynamic loading conditions may also be considered if atypical shipping conditions are predicted). Next, the physical size (maximum spans) of the rear bulkhead wall, baffles, and forward support walls are considered along with the mechanical properties of the materials used in their construction (elastic creep, tensile strength, etc.). If the selected tie-down straps exhibit a high degree of elasticity, or comprise longer lengths than those of the described embodiments, their contributions may also be included in the calculation. When taken together, those skilled in the art may generate suitably accurate predictors of deformation, thus allowing the container liner 102 to be pre-adjusted for length.

Figure 11A:
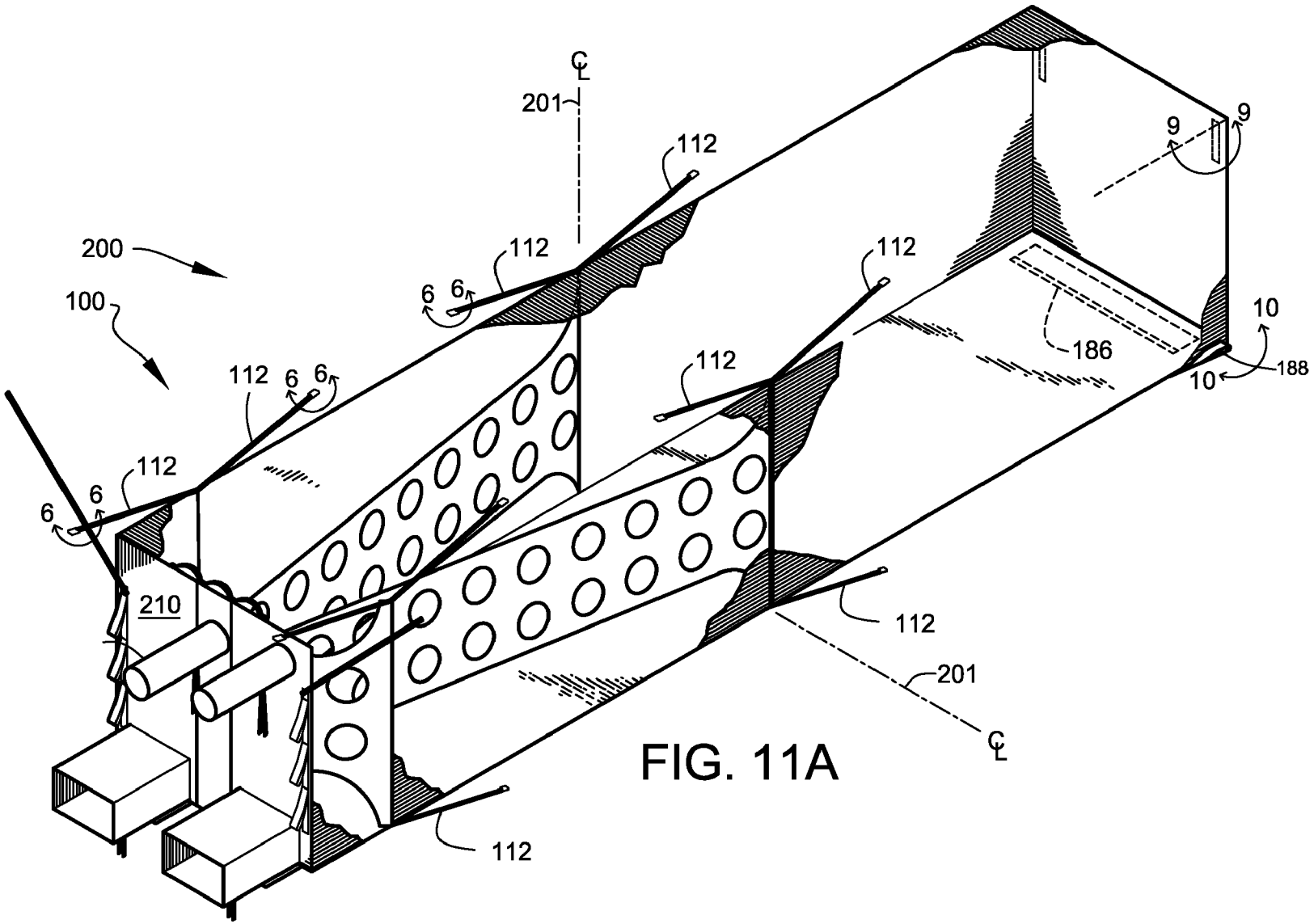
FIG. 11A shows a perspective view, in partial section, of another design of container liner according to another preferred embodiment of the present invention.
Figure 11B:
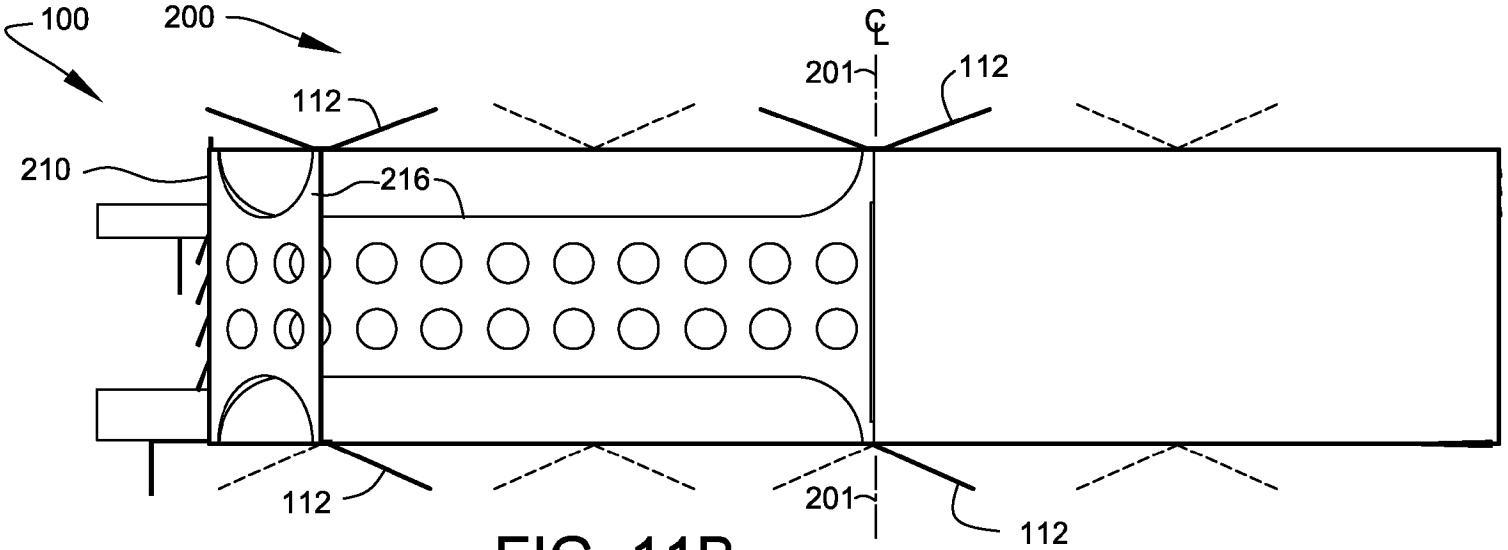
FIG. 11B shows a side view, in partial section, of the container liner of FIG. 11.
Figure 12:
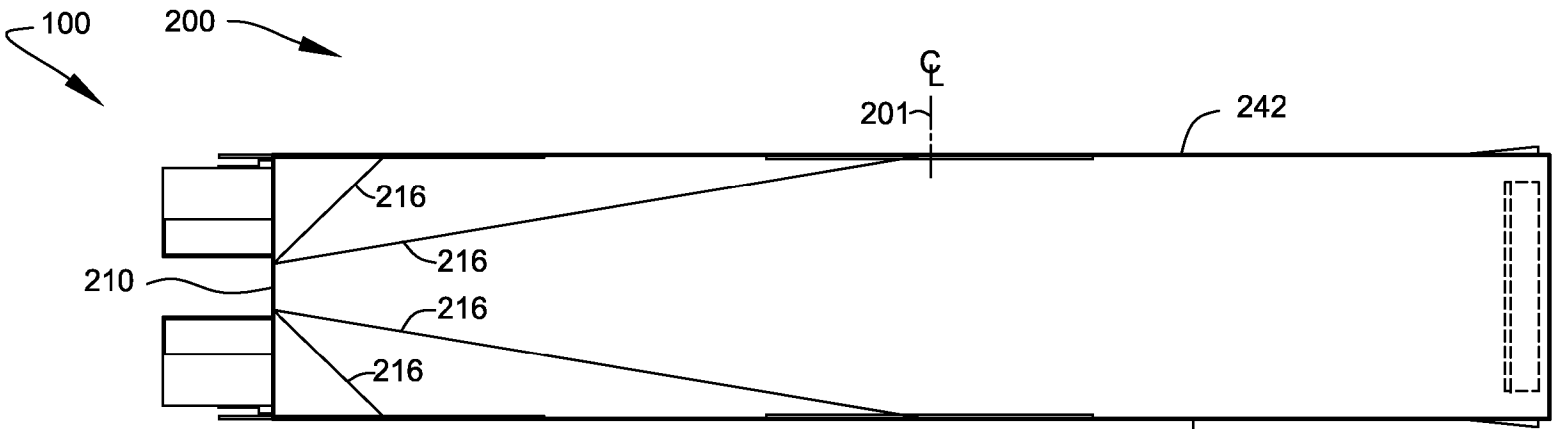
FIG. 12 shows a top view, in partial section, of the container liner of FIG. 11.

FIG. 11A shows a perspective view, in partial section, of alternate container liner 200, of container liner system 100, according to a highly preferred embodiment of the present invention. FIG. 11B shows a side view, in partial section, of alternate container liner 200, of container liner system 100, of alternate container liner 200 of FIG. 11A. FIG. 12 shows a top view, in partial section, of alternate container liner 200 of FIG. 11A. It should be noted that in the depiction of FIG. 11A and FIG. 11B the right sidewall and upper panel have been deleted from the view to more clearly depict the preferred interior arrangements of alternate container liner 200. Similarly, in the depiction of FIG. 12 the upper panel has been deleted from the view to further assist in depicting the preferred interior arrangements. Preferably, alternate container liner 200 comprises a liner of extended length, preferably accommodating the internal configurations of a shipping container 104 comprising a length of about 40 feet. Preferably, the structures and arrangements of alternate container liner 200 are substantially similar to those of container liner 102. Normally, internal baffles 216 of alternate container liner 200 extend forward from rear bulkhead 210 to intersect the approximate midline 201 of right sidewall 240 and left sidewall 242, as shown. The dashed line depiction of FIG. 11 illustrates the optional placement of additional tie-down straps 112 used when additional distribution of cargo loads is required.

Figure 13:
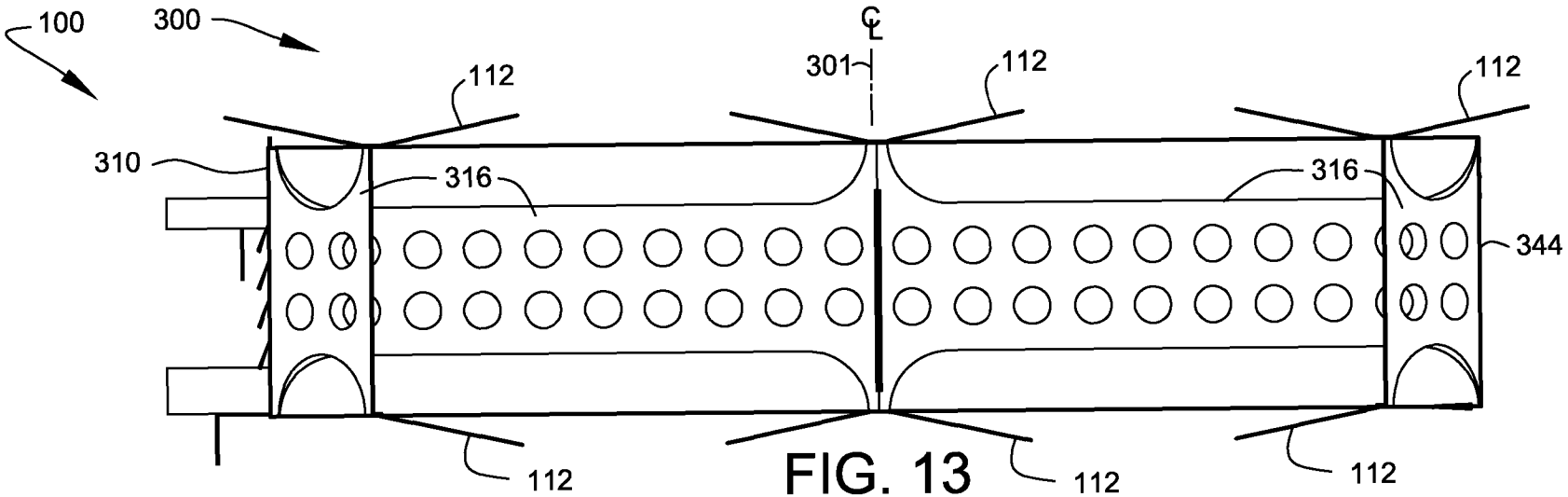
FIG. 13 shows a side view, in partial section, of an alternate container liner according to another preferred embodiment of the present invention.
Figure 14:
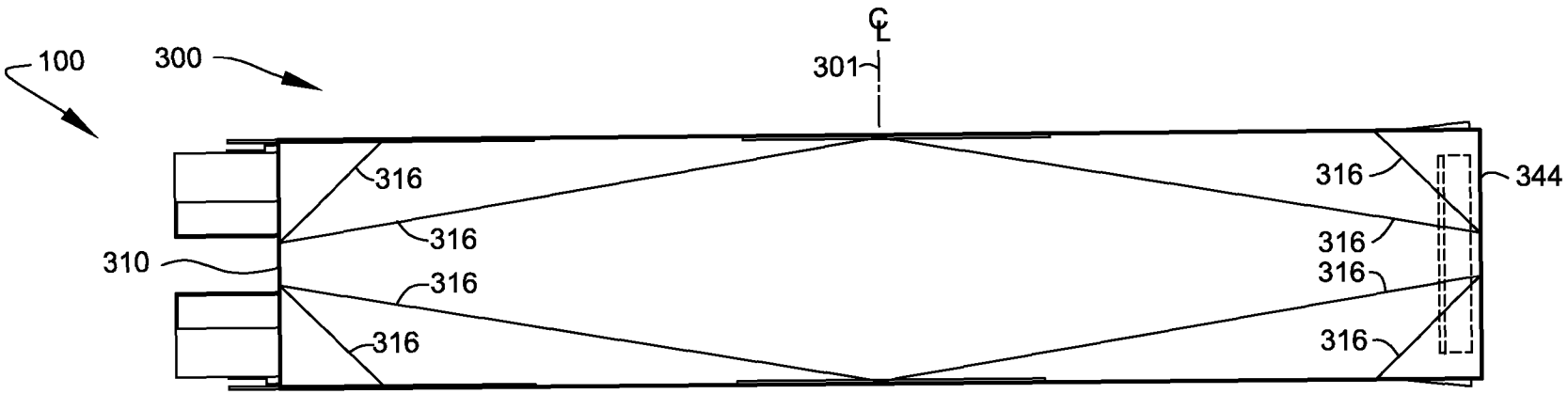
FIG. 14 shows a top view, in partial section, of the alternate container liner of FIG. 13.

FIG. 13 shows a side view, in partial section, of alternate container liner 300, of container liner system 100, according to another preferred embodiment of the present invention. FIG. 14 shows a top view, in partial section, of alternate container liner of FIG. 13. It is again noted that in the depiction of FIG. 13 the right sidewall has been deleted from the view to further assist in 40 depicting the preferred interior arrangements of alternate container liner 300. Similarly, in the depiction of FIG. 14 the upper panel has been deleted from the view to further assist in depicting the preferred interior arrangements.

In the preferred embodiment, alternate container liner 300 comprises a liner length accommodating the internal configurations of a shipping container 104 having a length of about 40 feet. For added strength, the baffle configuration of the prior embodiments has been repeated at the front of the liner. Preferably, alternate container liner 300 comprises a double set of internal baffles 316 that comprises a first set, extending forward from rear bulkhead 310, and an opposing set preferably extending rearward from forward bulkhead 344, as shown (at least embodying) herein wherein: the deflection limiter further comprises at one load-transfer-member adapted to transfer a direct line of tensional force between such a first sidewall and the substantially vertical front-boundary-wall, and at least one load-transfer-member adapted to transfer least one direct line of tensional force between the second sidewall and the substantially vertical rear boundary-wall). Preferably, both sets intersect the approximate midline 301 of right sidewall 340 and left sidewall 342, as shown. Preferably, apart from the unique baffle arrangements, the structures and configurations of alternate container liner 300 are substantially similar to those described for container liner 102.

FIG. 15 shows a side view, ill partial section, of alternate container liner 400 according to another preferred embodiment of the present invention. FIG. 16 shows a top view, in partial section, of alternate container liner 40 of FIG. 15. The upper and sidewalls have again been deleted from the view for clarity. In the preferred embodiment of FIG. 15 and FIG. 16, baffles 416 are attached to rear bulkhead wall 410 along a single vertical line, as shown. In 41 other preferred embodiments, opposing arrangements of baffles are included, for added strength at forward bulkhead 444, as indicated by the dashed line depiction of FIG. 16.

Thus, it is demonstrated by the teachings of this specification that container liner system 100 is, by the present invention, adapted to transfer cargo loads from an end bulkhead of the liner, to at least one mid-portion of the liner using an internal support panel. Furthermore, it is demonstrated by the teachings of this specification that container liner system 100 is adapted to transfer the cargo load from such mid-portions to a plurality of anchor points distributed along substantially the entire length of the shipping container. using a plurality of structural support members, preferably a plurality of adjustable structural support members. Unloading of flowable material 108 from bulk material liners is often accomplished utilizing a discharge hopper. Discharge hoppers transport flowable material 108 from the discharge chute of a container liner to the material handling equipment of the delivery site.

Figure 17:
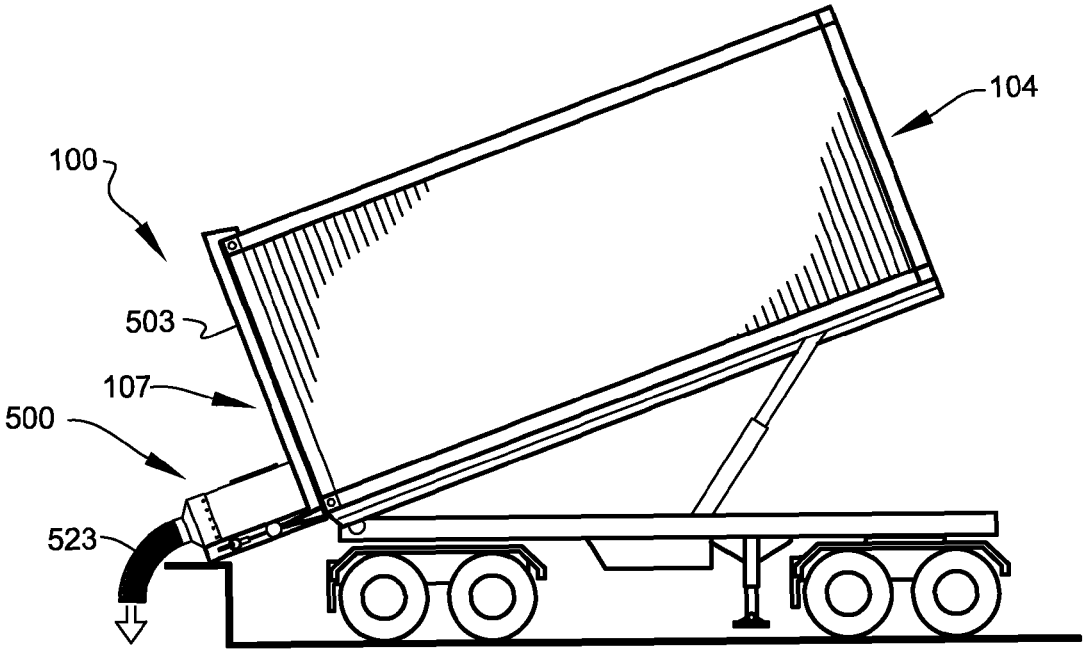
FIG. 17 shows a side view, in partial section, of a bulk-material discharge-hopper of the container liner system, according to a preferred embodiment of the present invention.

FIG. 17 shows a side view of bulk-material discharge-hopper 500 of container liner system 100, according to a preferred embodiment of the present invention. In the preferred embodiment, bulk material discharge-hopper 500 is adapted to maintain the liner discharge chutes in an optimal position within the hopper, thus reducing the chute's tendency to misshape or tear. Without the novel design arrangements of bulk-material discharge-hopper 500, portions of the liner placed within the hopper are susceptible to wrinkling, folding, and tearing; a condition brought about by uncontrolled and uneven pressure forces applied on the liner material during discharge. Such wrinkling, folding, and tearing of the liner slows the discharge process and can lead to contaminating the bulk material stream with torn liner material. The preferred use of bulk material discharge-hopper 500 substantially reduces problems associated with displacement of liner chutes within the hopper. Bulk-material discharge-hopper 500 provides improved discharge performance in most compatible bulk liners. In addition, the unique configuration of bulk-material discharge-hopper 500 takes full advantage of the increased discharge rate afforded by the use of the above-described liner embodiments of container liner system 100. Most preferably, bulk-material discharge-hopper 500 operates in combination with special liner embodiments of container liner system 100, as described below.

Figure 18:
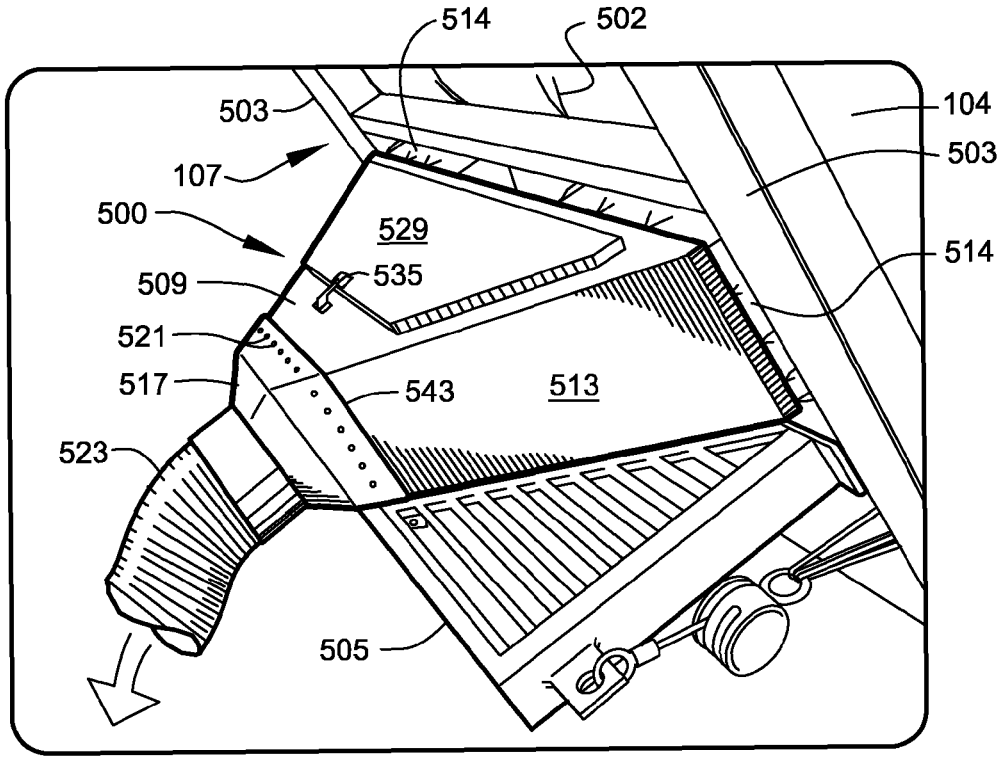
FIG. 18 shows a perspective view of the bulk-material discharge-hopper of FIG. 1.

In the preferred embodiment, bulk-material discharge-hopper 500 is mounted adjacent the lower rear opening 107 of shipping container 104, as shown. A temporary bulkhead 503 (generally not an element within the claimed embodiments of the present invention) provides a rigid structural framework that preferably overlays rear opening 107, as shown. FIG. 18 shows a perspective view of temporary bulkhead 503 with the bulk-material discharge-hopper 500 of FIG. 1 mounted adjacent the base of rear opening 107. In the preferred embodiments temporary bulkhead 503 comprises platform 505 projecting perpendicularly from the base of the bulkhead framework, as shown. Herein, temporary bulkhead 503 is adapted to support bulk-material discharge-hopper 500 in an operable position adjacent rear opening 107, as best shown in FIG. 18. Bulk-material discharge-hopper 500 is rigidly secured to the structural elements of platform 505, with the use of mechanical fasteners being preferred. When so secured, bulk-material discharge-hopper 500 is preferably located directly adjacent discharge chutes 514 of container liner 502, as shown. Bulk-material discharge-hopper 500 comprises a rigid cabinet having a hollow interior 507 (see FIG. 20). Preferably, bulk-material discharge-hopper 500 comprises a funnel-like shape generally resembling a trapezoidal prism, as shown. Also, an arrangement of substantially planer outer walls encloses a hollow interior 507, as shown.

The outer walls of bulk-material discharge-hopper 500 preferably comprise a generally trapezoidal-shaped upper wall 509 and a generally trapezoidal-shaped lower wall 511, as shown. In the preferred embodiment, both upper and lower walls adjoin a pair of opposing rectangular sidewalls 513, as shown. In addition, bulk material discharge-hopper 500 preferably comprises a generally rectangular forward wall 515 having a preferred width extending substantially the entire width of rear opening 107, as shown. The relatively narrow discharge end of bulk-material discharge-hopper 500 comprises a generally rectangular discharge opening 543, as shown. Discharge opening 543 is preferably fitted with hose adapter 517 that transitions the preferred rectangular opening of discharge opening 543 to a substantially circular outlet 545, as shown.

In the preferred embodiment, circular outlet 545 comprises hose coupler 519, as shown, adapted to couple bulk-material discharge-hopper 500 to transfer hose 523, as shown. Transfer hose 523 functions to transfer the bulk material from bulk material discharge-hopper 500 to the material handling equipment of the delivery site, as shown. Preferably, hose adapter 517 is remove ably mounted to bulk-material discharge-hopper 500 using a plurality of removable fasteners 521, as shown. This preferred feature allows a single bulk-material discharge-hopper 500 to be fitted with alternate site and/or equipment specific hose adapters 517. In preferred operation, the interchangeability of hose adapters allows bulk material discharge-hopper 500 to be modified to match the unloading requirements of a specific discharge site. Upon reading the teachings of this specification, those of ordinary skill in the art will now understand that, under appropriate circumstances, considering such issues as intended use, cost, etc., other mounting arrangements, such as, for example, utilizing a non-removable adapter, utilizing alternate and discharge shapes, utilizing power assist devices, etc., may suffice.

Figure 19:
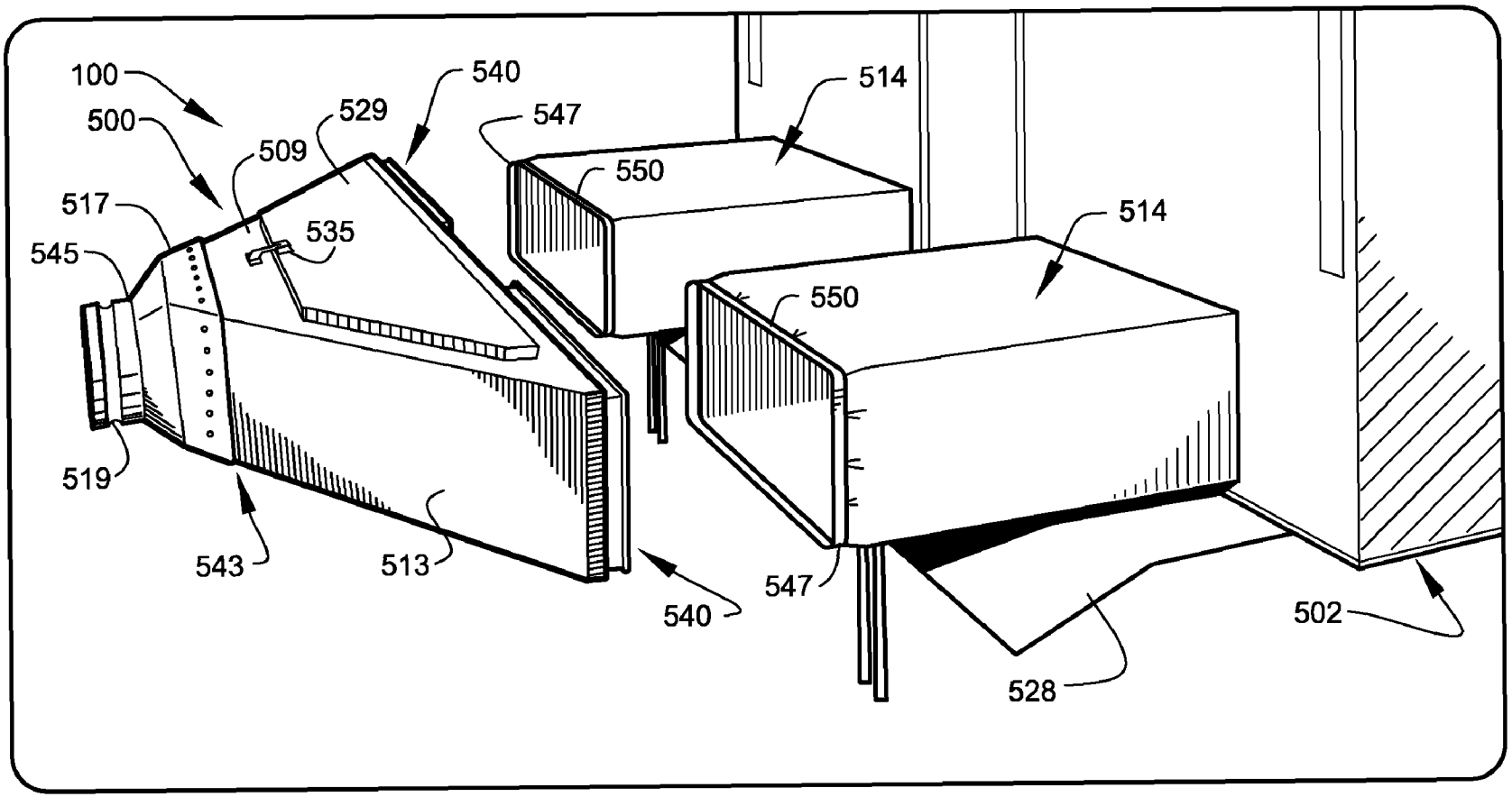
FIG. 19 shows a perspective view of the bulk-material discharge-hopper of FIG. 1 adjacent the discharge chutes of a container liner of the container liner system.
Figure 20:
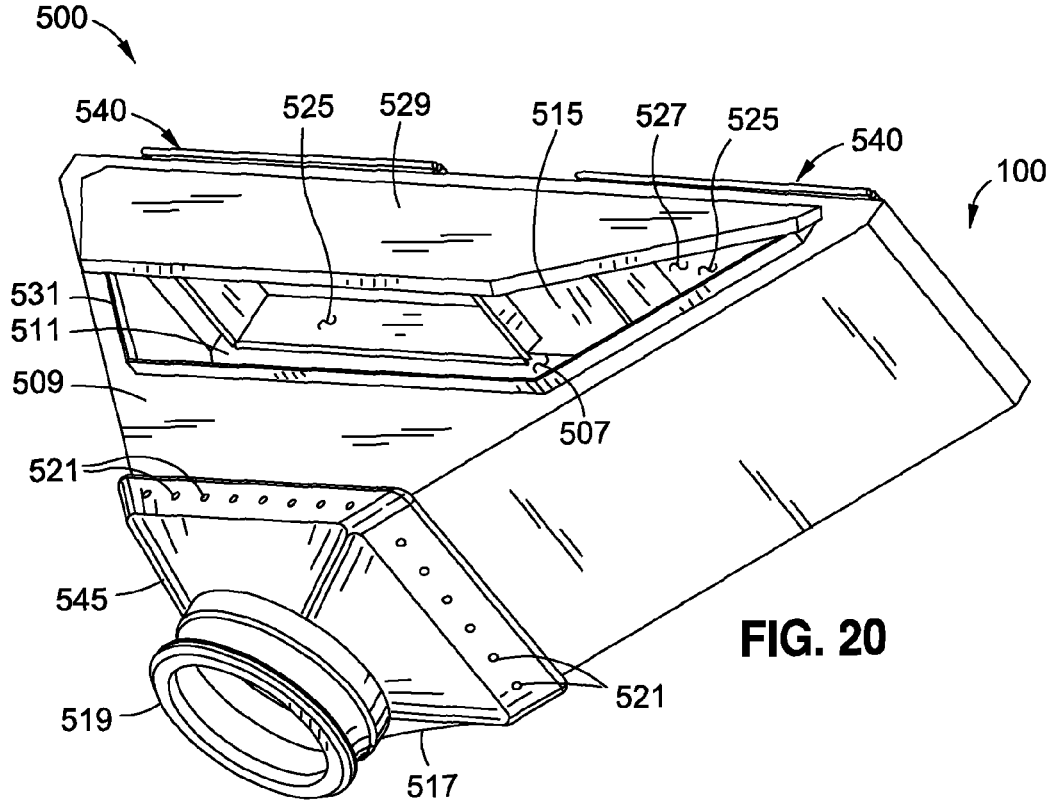
FIG. 20 shows a rear perspective view of the bulk-material discharge-hopper of FIG. 1.
Figure 21:
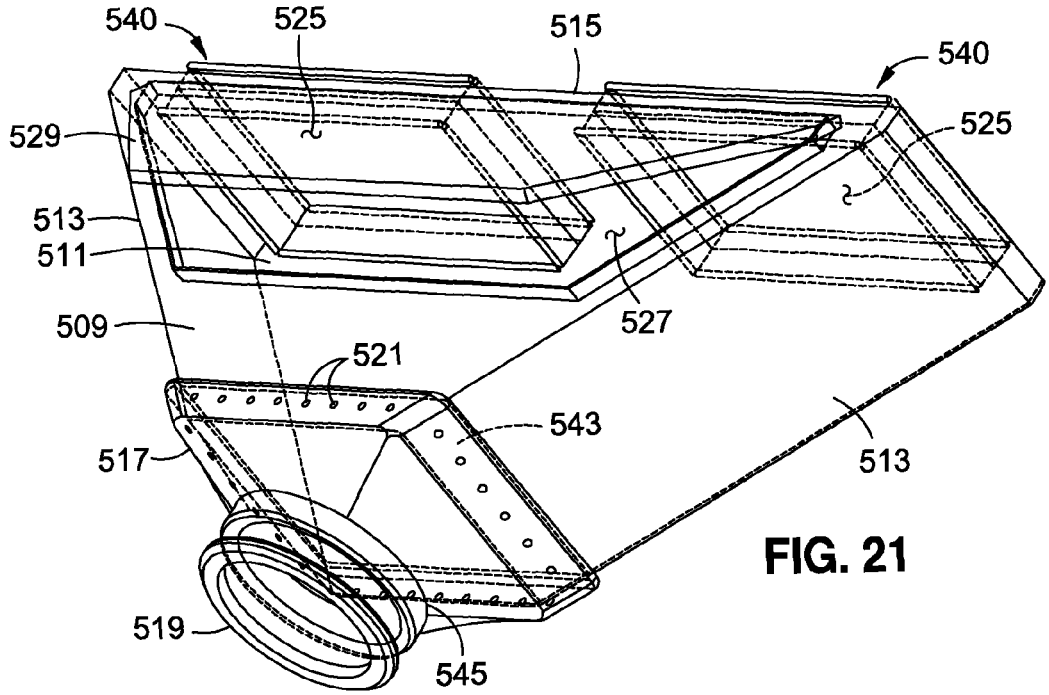
FIG. 21 shows a rear perspective view, of the bulk-material discharge-hopper of FIG. 1, depicting internal component relationships, with selected external surfaces rendered partially transparent for clarity.

FIG. 19 shows a perspective view of bulk-material discharge-hopper 500 of FIG. 1 adjacent discharge chutes 514 of container liner 502 of container liner system 100. FIG. 20 shows a rear perspective view of bulk-material discharge-hopper 500 of FIG. 1. FIGS. 21 shows a 44 rear perspective view, of bulk-material discharge-hopper 500 of FIG. 17 depicting internal component relationships, with selected external surfaces rendered partially transparent for clarity.

Figure 22:
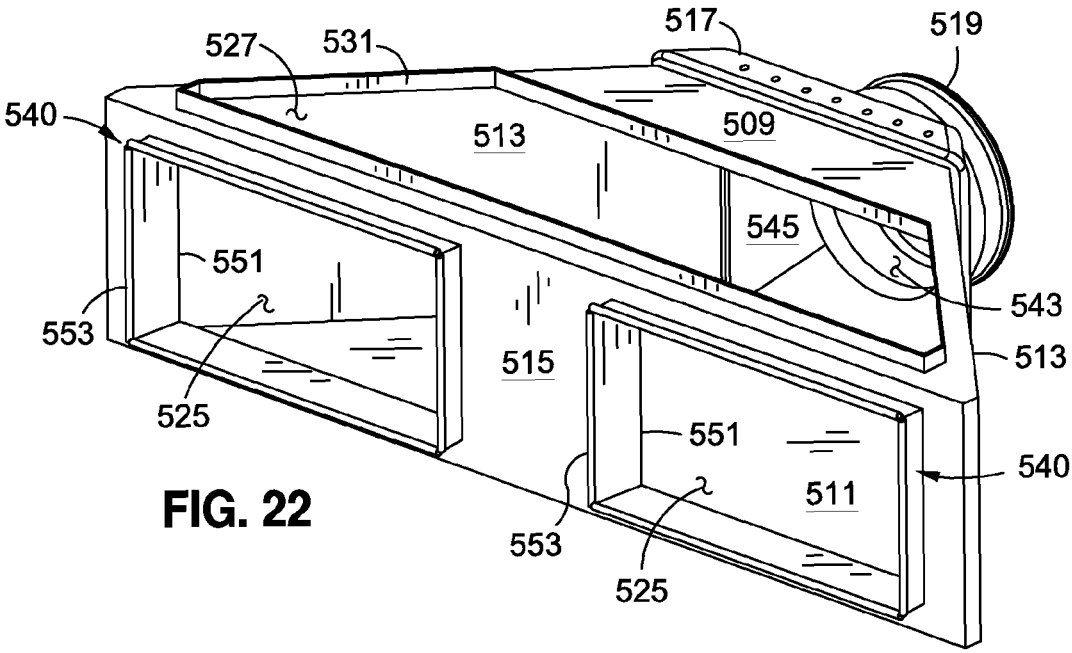
FIG. 22 shows a front perspective view of the bulk-material discharge-hopper of FIG. 1.
Figure 23:
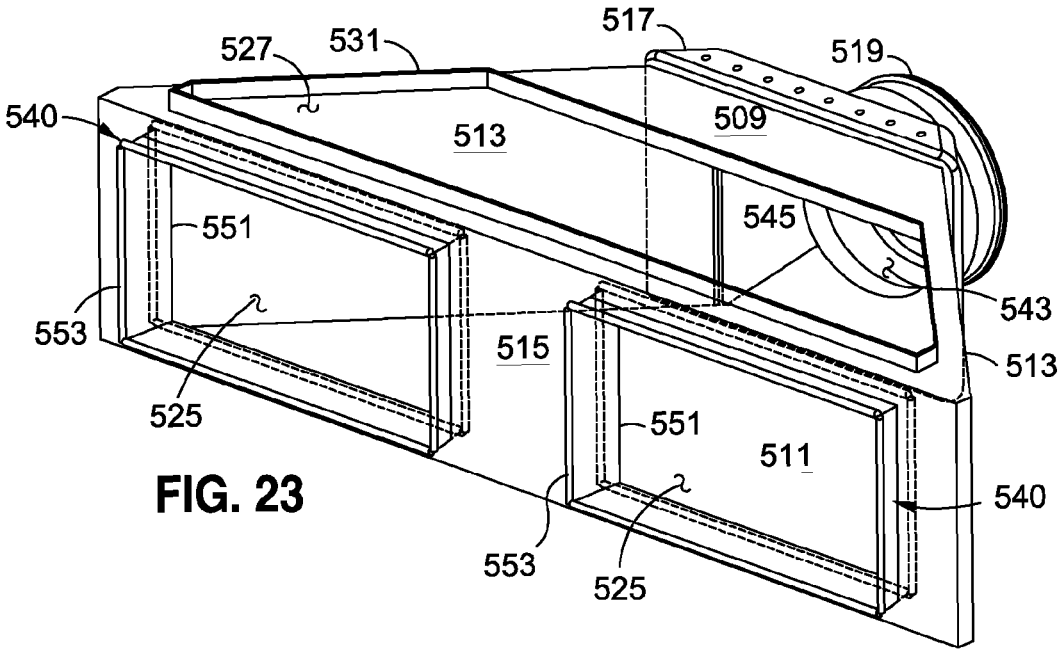
FIG. 23 shows a front perspective view, of the bulk-material discharge-hopper of FIG. 1, depicting internal component relationships, with selected external surfaces rendered partially transparent for clarity.

FIG. 22 shows a front perspective view of bulk-material discharge-hopper 500 of FIG. 1. FIGS. 23 shows a front perspective view, of bulk-material discharge-hopper 500 of FIG. 1, depicting internal component relationships, with selected external surfaces rendered partially transparent for clarity.

Reference is now made to FIG. 19 through FIG. 23 with continued reference to FIG. 17 and FIG. 18. In the preferred embodiment, bulk-material discharge-hopper 500 comprises at least one, and most preferably two forward apertures 525, as shown. Each aperture is structured and arranged to receive one of the two discharge chutes 514 of container liner 502, as shown. This preferred arrangement allows the discharge chutes to deliver the bulk material to hollow interior 507. Each aperture 525 generally comprises a rectangular shape and size generally matching that of the discharge chutes 514, as shown. Preferably, both apertures 525 are substantially symmetrical in design, as shown, with each aperture 525 comprising a substantially continuous peripheral flange assembly 540 that projects inward and outward from forward wall 515, as shown.

Access to interior 507 is provided through a single large access opening 527 located within upper wall 509, as shown. A continuous peripheral flange 531 projects upward from the periphery of opening 527, as shown, adding rigidity to upper wall 509 and functioning as a sealing surface adjacent the corresponding peripheral flange of hinged cover 529, as shown (for clarity in illustrating internal components of the hopper, hinged cover 529 is omitted from the views of FIG. 22 and FIG. 23). In the preferred embodiment. hinged cover 529 is adapted to seal 45 opening 597 during material discharge. Hand operable latch 535 maintains hinged cover 529 in the closed position depicted in FIG. 18, and releases hinged cover 529 allowing the cover to pivot upward for internal access. Upon reading the teachings of this specification, those of ordinary skill in the art will now understand that, under appropriate circumstances, considering such issues as intended use, size of hopper, etc., other access arrangements, such as, for example sliding panels, multiple ports, removable covers, etc., may suffice.

In the preferred embodiment, bulk-material discharge-hopper 500 is constructed from a substantially rigid material. For durability, bulk-material discharge-hopper 500 is constructed predominantly from steel. Upon reading the teachings of this specification, those of ordinary skill in the art will now understand that, under appropriate circumstances, considering such issues as intended use, cost, etc., other material arrangements, such as, for example, the use of plastics, fiberglass, composite materials, etc., may suffice.

Figure 24:
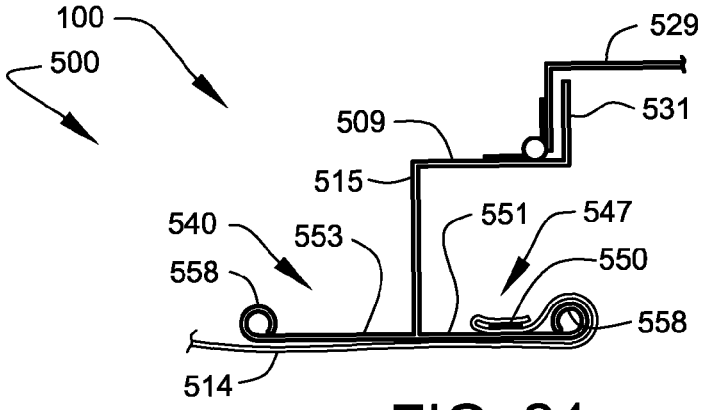
FIG. 24 shows a sectional view through a section taken through the upper flange assembly of a chute inlet, illustrating attachment of the container liner according to a preferred embodiment of the present invention.

FIG. 24 shows a sectional view through a section taken through the upper portion of peripheral flange assembly 540 of a chute inlet aperture 525, illustrating attachment of the container liner according to a preferred embodiment of the present invention.

Reference is now made to FIG. 24 with continued reference to FIG. 19. FIG. 19 illustrates alternate container liner 502 comprising as pair of modified discharge chutes 514, as shown. In the preferred embodiment the distal end 547 of each modified discharge chute 514 comprises elastic banding 550 adapted to secure distal end 547 to peripheral flange assembly 540 of bulk-material discharge-hopper 500, as shown. More specifically, distal end 547 of discharge chute 514 is inserted through aperture 525 and is firmly secured to interior inner flange section 551 of peripheral flange assembly 540 using elastic banding 550, as shown.

Discharge chute 514 is maintained in an optimal position by the physical restraint applied by inner flange section 551. Elastic-banding 550 extends circumferentially around distal end 547 of the chute, as shown. Preferably, elastic-banding 550 is permanently joined to distal end 547, as shown; elastic-banding S50 may be sewn to the surface of distal end 547. Alternately, elastic-banding 550 is captured within an edge casing, as shown. The casing is permanently formed by thermal bonding (such as ultrasonic welding) or by mechanical sewing (using a straight stitch or serge-type seaming). Upon reading the teachings of this specification, those of ordinary skill in the art will now understand that, under appropriate circumstances, considering such issues as intended use, cost, nature and liner material, etc., other attachment arrangements, such as, for example, drawstrings, detached elastic bands provided with the liner, "tensionable" circumferential bands, cord ties, "bungee" cords, hooks with corresponding islets, cohesive surfaces, adhesive-backed tapes, elastic bands surface bonded to the chute, hook and loop bands, etc., may suffice. Each discharge chute 514 preferably comprises a length somewhat longer than the prior chute embodiments to allow the above described securing to peripheral flange assembly 540.

Figure 25:
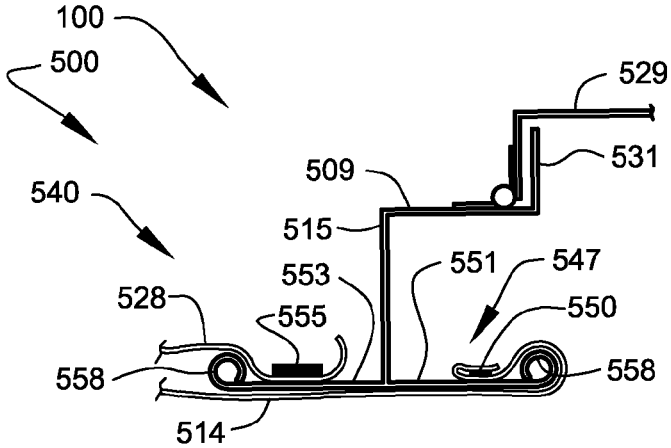
FIG. 25 shows a similar sectional view through a section taken through the upper flange assembly of a chute inlet, illustrating attachment of the container liner according to another preferred embodiment of the present invention.

FIGS. 24 illustrated the preferred attachment of discharge chute 514 to inner flange section 551 of the peripheral flange assembly 540. FIG. 25 shows a similar sectional view through the upper portion of peripheral flange assembly 540, illustrating attachment of both discharge chutes 514 and port covers 528 to peripheral flange assemblies 540, according to another preferred embodiment of the present invention. In the preferred installation of FIG. 25, port cover 528 is secured to outer flange section 553 of peripheral flange assembly 540 using elastic band 555 extending circumferentially around outer flange section 553, as shown. The securing of port cover 528 to peripheral flange assembly 540 further assists in maintaining discharge chutes 514 in an optimal configuration during discharge.

Figure 26:
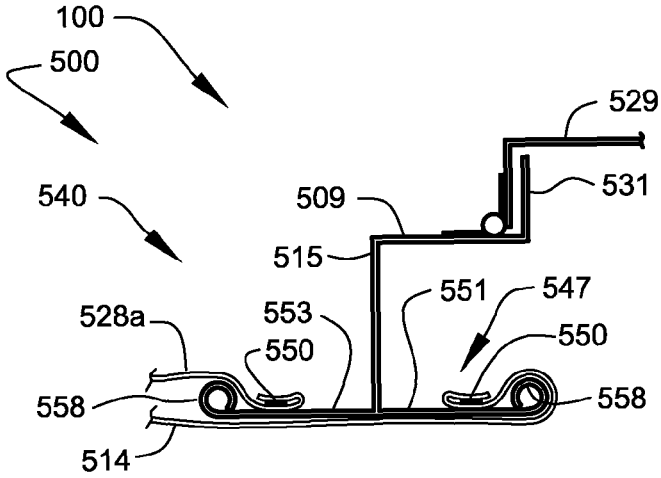
FIG. 26 shows an additional sectional view through a section taken through the upper flange assembly of a chute inlet, illustrating attachment of the container liner according to another preferred embodiment of the present invention. Appendix A includes additional material further enabling preferred embodiments and methods of the present invention.

FIG. 26 shows an additional sectional view through a section taken through the upper flange assembly of a chute inlet, illustrating attachment of the container liner according to another preferred embodiment of the present invention. In the preferred embodiment of FIG. 26, port covers 528have been further modified to comprise elastic-banding 550, as shown. In the preferred embodiment, each port cover 528*a* comprises a substantially continuous sleeve extending around its associated discharge chute 514. Elastic-banding 550 extends circumferentially around the distal end of port cover 528*a*, as shown.

Preferably, elastic-banding 550 is permanently joined to distal end 547*a*, as shown; and, elastic-banding 550 may be sewn to the surface of port covers 528*a* in a manner similar to that of discharge chutes 514. Alternately, elastic-banding 550 is preferably attached by capture within an edge casing as shown. Such casing is permanently formed by preferably by thermal bonding or by mechanical sewing.

Inner flange section 551 preferably projects inwardly from forward wall 515 a distance of about 50 millimeters (mm), as shown. Preferably, outer flange section 553 projects outwardly from forward wall 515 an equivalent distance of about 50 mm, as shown. The tendency of the chute material to tear by passing adjacent peripheral flange assembly 540 is reduced by the preferred addition of a smoothly transitioning terminal edge 558 along the periphery of both inner flange section 551 and outer flange section 553, as shown.

Upon reading the teachings of this specification those of ordinary skill in the art will now understand that, under appropriate circumstances, considering such issues as intended use, advances in discharge technology, etc., other discharge chute arrangements, such as, for example, using a single large chute, incorporating shape-holding structures etc., may suffice. Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the attached claims.

I claim:

1. An apparatus and system for containing and controlling a flowable material within the interior of a cargo container, said apparatus and system comprising:

a separating enclosure adapted to separately enclose substantially an entire volume of an interior of the cargo container;

wherein said separating enclosure comprises an interior chamber adapted to contain the flowable material within said separating enclosure;

wherein said interior chamber comprises a substantially vertical rear-boundary-wall, a substantially vertical front-boundary-wall, a substantially vertical first sidewall, a substantially vertical second sidewall, and a deflection limiter adapted to limit deflection of said substantially vertical rear-boundary-wall under a load imposed by the flowable material during containment within said separating enclosure and further adapted to guide flowable material towards a center of the substantially vertical rear-boundary-wall during discharge; and wherein said deflection limiter comprises at least four load transfer members, a first load transfer member attached to said substantially vertical rear-boundary-wall and said substantially vertical first sidewall, a second load transfer member attached at a different angle than first load transfer member to said substantially vertical rear-boundary-wall and at least one of said substantially vertical first sidewall and said substantially vertical front-boundary-wall, a third load transfer member attached to said substantially vertical rear-boundary-wall and said substantially vertical second sidewall, and a fourth load transfer member attached at a different angle than third load transfer member to said substantially vertical rear-boundary-wall and at least one of said substantially vertical second sidewall and said substantially vertical front-boundary-wall.

2. The apparatus and system according to claim 1 wherein said interior chamber further comprises:

a substantially horizontal lower-containment-panel, and wherein said load transfer members do not intersect said substantially horizontal lower-containment-panel.

3. The apparatus and system according to claim 2 wherein said interior chamber further comprises:

a substantially horizontal upper-containment-panel;

wherein said substantially vertical rear-boundary-wall, said substantially vertical front-boundary-wall, said substantially vertical first sidewall, and said substantially vertical second sidewall adjoin said substantially horizontal upper-containment-panel and said substantially horizontal lower containment-panel.

4. The apparatus and system according to claim 1 wherein said separating enclosure comprises substantially flexible material.

5. The apparatus and system according to claim 1 wherein said second and fourth load transfer members attach to said substantially vertical rear-boundary-wall at an angle greater than 45 degrees with respect to a plane comprising said substantially vertical rear-boundary-wall.

6. The apparatus and system according to claim 3 wherein said load transfer members comprise:

a rear-boundary-wall end structured and arranged to intersect said substantially vertical rear-boundary-wall; and a forward-boundary-wall end structured and arranged to intersect at least one of said substantially vertical front-boundary-wall, said substantially vertical first side wall, and said substantially vertical second sidewall.

7. The apparatus and system according to claim 6 wherein:

said rear-boundary-wall end comprises a rear attacher adapted to attach said rear boundary-wall-end to said substantially vertical rear-boundary-wall; and said forward boundary-wall-end comprises a forward attacher adapted to attach said forward boundary-wall-end to said at least one of said substantially vertical front-boundary-wall, said substantially vertical first sidewall, and said substantially vertical second sidewall.

8. The apparatus and system according to claim 7 wherein said forward attacher comprises an anchor adapted to removably attach said separating enclosure within the interior.

9. The apparatus and system according to claim 8 wherein:

said rear attacher comprises rear attachment-length;

said forward attacher comprises forward attachment-length; and said rear attachment-length and said forward attachment-length are each oriented substantially perpendicular to said substantially horizontal lower-containment-panel.

10. The apparatus and system according to claim 9 wherein said rear attachment-length extends substantially between said substantially horizontal lower-containment-panel and said substantially horizontal upper-containment-panel.

11. The apparatus and system according to claim 9 wherein said forward attachment-length extends substantially between said substantially horizontal lower-containment panel and said substantially horizontal upper-containment-panel.

12. The apparatus and system according to claim 1 wherein said separating enclosure further comprises restraint-bar supporter adapted to assist in supporting restraint bar in position assisting restraint of said substantially flexible material against movement.

13. The apparatus and system according to claim 8 wherein said anchor comprises:

an external load-transfer-member adapted to transfer load between said separating enclosure and the cargo container;

wherein said external load-transfer-member is located substantially outside said interior chamber.

14. The apparatus and system according to claim 13 wherein:

a portion of the load applied to said separating enclosure is generated by containment of the flowable material within said interior chamber; and said external load-transfer-member comprises a load divider adapted to assist in dividing the transfer of the load between a plurality of anchor points distributed along substantially a full length of the interior of the cargo container.

15. The apparatus and system according to claim 14 wherein:

said external load-transfer-member comprises an anchor strap;

said anchor strap comprises a first strap-end and a second strap-end;

said first strap-end is firmly coupled to said separating enclosure; and, said second strap-end is adapted to assist anchoring of said anchor strap to the cargo container.

16. The apparatus and system according to claim 15 wherein said anchor strap further comprises a tensioner member adapted to generate tensional force between said first strap-end and said second strap-end.

17. The apparatus and system according to claim 16 wherein:

said substantially horizontal lower-containment-panel comprises at least one peripheral edge;

said at least one peripheral edge comprises said anchor strap;

the tensioning of said anchor strap by said tensioner member assists in drawing said substantially horizontal lower-containment-panel substantially within a single geometric plane; and discharge of the flowable material from said interior chamber is assisted by positioning said substantially horizontal lower containment-panel substantially within said single geometric plane.

18. The apparatus and system according to claim 1 wherein said load-transfer-members comprise:

a substantially unitary planar panel; and an aperture adapted to provide passage of the flowable material through said substantially unitary planar panel.

19. The apparatus and system according to claim 8 wherein:

said substantially horizontal upper-containment-panel comprises said anchor; and said substantially horizontal lower-containment-panel comprises said anchor.

20. The apparatus and system according to claim 1 wherein said deflection limiter further comprises a fifth load-transfer-member attached to said first sidewall and said substantially vertical front-boundary-wall; and a sixth load-transfer-member attached to said second sidewall and said substantially vertical front-boundary-wall.

21. The apparatus and system according to claim 1 wherein said substantially vertical rear boundary-wall comprises passage structured and arranged to pass the flowable material therethrough.

22. The apparatus and system according to claim 21 wherein said passage comprises at least one projecting tubular passage structured and arranged to transfer the flowable material between said interior chamber and flowable material receiving apparatus.

23. The apparatus and system according to claim 22 wherein:

said projecting tubular passage comprises at least one chute coupler structured and arranged to securely couple said projecting tubular passage to the flowable material receiving apparatus; and the coupling of said projecting tubular passage to the flowable material receiving apparatus assists in maintaining said projecting tubular passage in position assisting flow of the flowable material from said interior chamber.

24. The apparatus and system according to claim 23 wherein:

said projecting tubular passage comprises a proximal end coupled to said substantially vertical rear-boundary-wall and distal end through which the flowable material is discharged; and said chute coupler comprises a circumferential elastic band circumferentially coupled to said distal end.

25. The apparatus and system according to claim 24 further comprising:

said flowable material receiving apparatus;

wherein said flowable material receiving apparatus comprises a discharge hopper;

wherein said discharge hopper comprises a substantially rigid cabinet comprising a plurality of substantially planer outer walls enclosing a hollow interior, wherein said plurality of substantially planer outer walls comprise a generally trapezoidal-shaped upper wall, a substantially trapezoidal-shaped lower wall, a first sidewall, a second sidewall, a forward wall, and a discharge opening;

wherein said forward wall comprises a forward aperture structured and arranged to receive said projecting tubular passage;

wherein said forward aperture comprises a substantially continuous peripheral flange assembly structured and arranged to support the securing of said projecting tubular passage adjacent said forward aperture by said chute coupler; and wherein the securing of said projecting tubular passage to said forward aperture assists in maintaining said projecting tubular passage in such position assisting the flow of the flowable material during discharge from said interior chamber.

26. The apparatus and system according to claim 25 wherein:

said generally trapezoidal-shaped upper wall comprises an access opening structured and arranged to allow user access to said interior chamber; and said access opening comprises a user operable cover structured and arranged to cover said access opening during discharge of the flowable-material.

27. A method related to the handling of flowable-material within an interior of a cargo container using the apparatus of claim 1, said method comprising the steps of:

providing within such cargo container, liner material adapted to separately enclose the flowable-material within the cargo container, wherein such liner material comprises at least one substantially flexible floor panel;

anchoring such separating enclosure within the interior using an anchor strap, the anchor strap comprising a first strap-end and a second strap-end; the first strap-end being firmly coupled to separating enclosure; and said second strap-end is adapted to assist anchoring of said anchor strap to the cargo container comprising a tension member adapted to generate tensional force between said first strap-end and said second strap-end, increasing tension on the anchor strap through tightening of the tension member causing the anchor strap to draw such substantially flexible floor panel substantially within a single geometric plane, whereby discharge of the flowable material from such separating enclosure is assisted by positioning such substantially flexible floor panel substantially within such single geometric plane.

28. The apparatus and system of claim 1 further comprising:

a plurality of anchor members, each one of said plurality adapted to anchor said separating enclosure within the interior;

wherein of said plurality of anchor members comprises tensioning device adapted to generate tensional force between said separating enclosure and the interior.

29. The apparatus and system according to claim 28 wherein:

each one of said plurality of anchor members comprises an anchor strap permanently attached to said separating enclosure; and said tensioning device comprises an adjustable buckle.

30. The apparatus and system of claim 28 wherein:

containment of the flowable material within said interior chamber generates a load applied to said separating enclosure; and, wherein said plurality of structural anchor members comprises a load distributing arrangement adapted to assist in distributing a portion of the load between the plurality of anchor points distributed along substantially the full longitudinal length of the interior chamber.

31. An apparatus and system related to a flowable material liner adapted to separately enclose flowable material within a cargo container and further comprising:

said flowable material liner comprising at least one tubular discharge passage, a discharge hopper structured and arranged to receive discharge flow of the flowable material from one or more tubular discharge passages and funnel the flow of flowable material into a single outlet;

wherein said discharge hopper is removably attached to said flowable material liner and said cargo container;

wherein said discharge hopper comprises a substantially rigid cabinet;

wherein said substantially rigid cabinet comprises a plurality of substantially planer outer walls enclosing a hollow interior;

wherein said plurality of substantially planer outer walls comprise a generally trapezoidal-shaped upper wall, a substantially trapezoidal-shaped lower wall, a first sidewall, a second sidewall, a forward wall; and, a discharge opening; wherein said forward wall comprises a forward aperture structured and arranged to receive the tubular discharge passage;

wherein said forward aperture comprises a substantially continuous peripheral flange assembly structured and arranged to support the securing of the tubular discharge passage adjacent said forward aperture by coupler device; and wherein such securing of the tubular discharge passage to said forward aperture assists in maintaining the tubular discharge passage in position assisting the discharge flow of the flowable material during discharge from the interior chamber.

32. The apparatus and system according to claim 31 wherein:

said generally trapezoidal-shaped upper wall comprises an access opening structured and arranged to allow user access to said interior chamber; and, said access opening comprises a user operable cover structured and arranged to cover said access opening during the discharge of the flowable-material.

* * * * *